US010633873B2

(12) United States Patent
Siltala et al.

(10) Patent No.: US 10,633,873 B2
(45) Date of Patent: Apr. 28, 2020

(54) SCAFFOLDING ARRANGEMENT

(71) Applicant: FAST BEAM OY, Klaukkala (FI)

(72) Inventors: Timo Siltala, Jyvaskyla (FI); Antti Hyvonen, Klaukkala (FI)

(73) Assignee: FAST BEAM OY, Klaukkala (FI)

( * ) Notice: Subject to any disclaimer, the term of this patent is extended or adjusted under 35 U.S.C. 154(b) by 204 days.

(21) Appl. No.: 15/528,640

(22) PCT Filed: Nov. 20, 2015

(86) PCT No.: PCT/FI2015/050810
§ 371 (c)(1),
(2) Date: May 22, 2017

(87) PCT Pub. No.: WO2016/079388
PCT Pub. Date: May 26, 2016

(65) Prior Publication Data

US 2017/0260758 A1 Sep. 14, 2017

(30) Foreign Application Priority Data

Nov. 21, 2014 (WO) ..... PCT/FI2014/050893

(51) Int. Cl.
*E04G 3/24* (2006.01)
*E04G 1/15* (2006.01)
(Continued)

(52) U.S. Cl.
CPC ..... *E04G 3/243* (2013.01); *E01D 19/10* (2013.01); *E01D 19/106* (2013.01); *E01D 21/00* (2013.01);
(Continued)

(58) Field of Classification Search
CPC ..... E04G 3/243; E04G 3/246; E04G 7/28; E01D 21/00
See application file for complete search history.

(56) References Cited

U.S. PATENT DOCUMENTS 737,377 A * 8/1903 England ..... E04G 3/24 182/128
2,906,365 A * 9/1959 Howard ..... E04G 3/24 182/136
(Continued)

FOREIGN PATENT DOCUMENTS

AT 213 946 B 3/1961
CN 1 644 847 A 7/2005
(Continued)

OTHER PUBLICATIONS

International Search Report, dated Mar. 11, 2016, from corresponding PCT/FI2015/050810 application.
(Continued)

*Primary Examiner* — Colleen M Chavchavadze
(74) *Attorney, Agent, or Firm* — Young & Thompson

(57) ABSTRACT

According to an example aspect of the present invention, there is provided a scaffolding arrangement to be attached to a deck structure, comprising a set of arms (2) including a carrier beam (5) for carrying the working levels and support structures needed in work, an attachment frame (1) for attaching the set of arms to the upper surface of the deck structure and platforms (103, 104, 105) for forming working levels.

12 Claims, 17 Drawing Sheets

(51) Int. Cl.

| | |
|---|---|
| ***E04G 11/36*** | (2006.01) |
| ***E01D 19/10*** | (2006.01) |
| ***E04G 13/06*** | (2006.01) |
| ***E01D 21/00*** | (2006.01) |
| ***E04G 7/28*** | (2006.01) |

(52) U.S. Cl.

CPC ..... *E04G 1/154* (2013.01); *E04G 7/28* (2013.01); *E04G 11/365* (2013.01); *E04G 13/066* (2013.01)

(56) References Cited

U.S. PATENT DOCUMENTS

| | | | | |
|---|---|---|---|---|
| 4,919,230 | A * | 4/1990 | Langer | E04G 1/15 182/186.8 |
| 5,083,739 | A * | 1/1992 | Shook | E01D 21/00 249/177 |
| 5,678,654 | A | 10/1997 | Uzawa | |
| 5,755,981 | A * | 5/1998 | Payne | E01D 21/00 249/24 |
| 6,223,856 | B1 | 5/2001 | Schwoerer | |
| 6,715,729 | B2 * | 4/2004 | Hambelton | E01D 21/00 249/24 |
| 7,159,262 | B2 * | 1/2007 | Jackson | E01D 21/00 14/77.1 |
| 8,595,989 | B1 * | 12/2013 | Greene | E04H 7/065 52/82 |
| 9,493,957 | B2 * | 11/2016 | Miller | E04G 3/243 |
| 2006/0175130 | A1 * | 8/2006 | Riley | E04G 3/20 182/82 |
| 2006/0243524 | A1 * | 11/2006 | Jarrell | E04G 5/062 182/82 |
| 2013/0098709 | A1 | 8/2013 | Miller et al. | |
| 2013/0313045 | A1 | 11/2013 | Jorkama et al. | |
| 2014/0151153 | A1 * | 6/2014 | Mork | E04G 5/062 182/82 |
| 2016/0237702 | A1 * | 8/2016 | Micklan | E04G 3/246 |

FOREIGN PATENT DOCUMENTS

| | | | |
|---|---|---|---|
| CN | 203188601 | | 9/2013 |
| DE | 21 44 035 | A1 | 3/1973 |
| DE | 4344210 | A1 | 6/1995 |
| DE | 199 22 005 | A1 | 11/2000 |
| EP | 0 308 882 | A2 | 3/1989 |
| EP | 1 857 610 | A1 | 11/2007 |
| ES | 2 288 074 | A1 | 12/2007 |
| JP | H03 61053 | U | 6/1991 |
| JP | H0544202 | A | 2/1993 |
| JP | H11241312 | A | 9/1999 |
| JP | 2000 017832 | A | 1/2000 |
| JP | 2000291254 | A | 10/2000 |
| JP | 2000336924 | A | 12/2000 |
| SE | 462864 | B | 9/1990 |
| WO | 98/41712 | A1 | 9/1998 |
| WO | 2008/132277 | A1 | 11/2008 |
| WO | 2012/062968 | A1 | 5/2012 |
| WO | 2014/121346 | A1 | 8/2014 |

OTHER PUBLICATIONS

International Search Report, dated Jul. 24, 2015, from corresponding PCT/FI2014/050893 application.

Chinese Office Action for Application No. 201580073807.0 dated Mar. 15, 2019 with English translation provided.

* cited by examiner

SCAFFOLDING ARRANGEMENT

FIELD

The present invention relates to scaffolding arrangement intended to form working stages, platforms and the support structures required in work for use in connection with repair, installation, and maintenance work on bridges and other structures with a deck.

BACKGROUND

Publication WO 2008/132277 A1 discloses one scaffolding arrangement suitable for repair work on a bridge deck. The arrangement consists of a number of scaffolding supports to be installed on the deck of the bridge, which are supported from the bridge by bolting the support to the upper surface of the deck of the bridge and then carrying the support on rotatable support elements on the undersurface of the deck.

Publication WO 2012/062968 A1 discloses an attachment element for attaching a scaffolding support to the deck of a bridge. The scaffolding support to be attached is arranged to be carried on two support points to the upper side of the deck of the bridge. At least one of the support points is arranged to take the compressive force of the attachment elements attached to the deck of the bridge and at least one is arranged to take the tensile force. The attachment element is arranged to be detachably attached to the deck of the bridge with at least two attachment means and comprises at least one attachment means for attaching the attachment element to the support point taking the tensile force of the scaffolding support.

Because scaffolding supports must be able to carry quite a large load of repair tools, repair workers, and possibly casting formwork and similar, the supports easily become quite massive. Thus, lifting means are needed to handle them and heavy vehicles to transport them. In addition, the installation of the supports usually requires several people. All these factors increase the repair costs.

One particular problem related to arranging scaffolding for repairing of decks and bridges is accommodation of the scaffolding itself, walking platforms, edge molds and such to curving edges. The curvature can be concave or convex in horizontal or vertical direction or both. In such cases it is difficult and time consuming to set the scaffolding to follow the form of the edge.

SUMMARY OF THE INVENTION

According to a first aspect, the invention defines a scaffolding arrangement, such as set forth in the independent claim. Some specific embodiments are defined in the dependent claims.

The present invention is intended to create a solution, in which scaffolding arrangement comprises platforms by which it is possible to build a at least a walkway that curves according to the curvature of an edge of a deck, for example such as a deck of a bridge.

One embodiment of the invention is intended to create a solution for forming an edge mold that follows the curvature of an edge of a deck.

Further, the invention's embodiments are intended to create an arrangement wherein the position of at least one wall of an edge mold can be adjusted.

Further, the invention's embodiments are intended to create a scaffolding arrangement that is easy to mount and accommodate even to curving edge forms of a deck.

The invention's embodiments are also intended to provide a scaffolding arrangement that can be mounted my using minimum amount of tools.

The invention's embodiments are also intended to provide an easily mountable railing.

The invention is based on the arrangement comprises a locking mechanism for locking at least one platform used for forming a working area to carrier beams of scaffolds so that the locking mechanism allows enough play so that the platform can be tilted in relation to the longitudinal axis of the carrier beam and at least one support shelf formed on the carrier beam for supporting the platform and dimensioned wide enough to allow tilting of the platform.

According to one embodiment of the invention at least two platforms are provided, of which at least one has at least one edge that forms an angle with at least one adjoining edge.

According to one embodiment of the invention, the at least one platform is a trapezoid, preferably isosceles trapezoid.

According to one embodiment of the invention, at least one platform comprises at least one keyhole profile.

According to one embodiment of the invention, the locking mechanism allows an adjustment for 1-5°, preferably 1-3°.

In an embodiment, the bracket comprises a push beam, a leg profile, and a rigging screw.

In another embodiment, the bracket comprises two openings in the leg profile. According to an embodiment, grooves are arranged at two sides of each opening. The grooves may have a different phase on opposite sides of the respective opening.

In an embodiment, at least one of a first locking mechanism and a second locking mechanism comprises a tooth key.

According to an embodiment, the push beam is configured to rotate about an axis of rotation relative to the leg profile. At least a portion of the push beam can be arranged within the leg profile In an embodiment, the arrangement comprises at least one mold made of foam.

According to an embodiment, the arrangement includes at least one lower platform.

In an embodiment, the arrangement includes adjustable support legs.

In another embodiment, the arrangement includes a gangway comprising an adjustable walkway.

According to an embodiment, the gangway includes a plurality of fixing positions.

In an embodiment, the arrangement includes a rail.

In another embodiment, the arrangement includes a trolley.

According to an embodiment, the trolley includes wheels which can be adjusted in vertical direction.

In an embodiment, the arrangement comprises a console including a lashing.

According to an embodiment, a position of the lashing is adjustable in relation to the platform.

According to another embodiment, the arrangement comprises a roof including at least one of a light, an electric supply, a pressure supply, and a heating air supply.

According to a second aspect of the present invention, there is provided a method, comprising causing measuring dimensions of an object, storing measurement data, selecting a number of platforms of a scaffolding arrangement, and calculating installation coordinates for hangers.

Various embodiments of the second aspect may comprise at least one feature from the following bulleted list:

- the object is a bridge or a part of a bridge
- the number of platforms is selected based on curvatures of the object
- a number of platform levels is selected based on curvatures of the object
- the method further comprising:
  - receiving information from a user via a telecom network relating to measurement data,
  - receiving information from the user via the telecom network relating to the number of platforms,
  - sending from a service provider information via the telecom network relating to the calculated installation coordinates
- the method further comprising:
  - sending information from a service provider via telecom network relating to at least one of a list of parts of a scaffolding arrangement, a timetable, a strength analysis, a maintenance history of the parts of the scaffolding arrangement, tracking data of the parts of the scaffolding arrangement, and a visualization of the scaffolding arrangement and the object
- the method yet further comprising:
  - causing cutting of foam molds of a scaffolding arrangement,
  - storing cutting data of the foam molds automatically,
  - processing a selection of at least one specific foam mold received from a user,
  - causing at least one load to be applied on the at least one selected foam mold,
  - performing a strength analysis for the at least one selected foam mold numerically
- the method comprising:
  - processing a selection of at least one lashing received from a a user,
  - causing the at least one load to be applied on the at least one selected foam mold including the at least one lashing,
  - performing a strength analysis for the at least one selected foam mold including the at least one lashing numerically
- the foam molds are cut by means of a CNC milling machine or a cutting device
- the strength analysis is performed using a computer readable medium having stored thereon a set of computer implementable instructions capable of causing a processor to calculate a deformation of the at least one selected foam mold depending on the at least one applied load
- the calculated deformation is compared to a tolerance value
- the method yet further comprising:
  - processing a selection of at least one other foam mold,
  - causing at least one mold to be applied on the at least one other selected foam mold,
  - performing a strength analysis for the at least one other selected foam mold numerically,
  - calculating a deformation of the at least one other foam mold and comparing the deformation to a tolerance value
- the at least one selected foam mold or the at least one other selected foam mold is used in a scaffolding arrangement
- the method comprising:
  - sending information from a service provider via telecom network relating to cutting data,
  - receiving information from the user via telecom network relating to the at least one selected foam mold and the at least one load,
  - sending information from the service provider via telecom network relating to a strength analysis result
- the method further comprising:
  - sending information from the service provider via telecom network relating to the cutting data of the at least one selected foam mold to the user, a CNC milling machine, or a computer readable medium
- foam molds are pressed, burned, or recycled after use According to a third aspect of the present invention, there is provided a computer readable medium having stored thereon a set of computer implementable instructions capable of causing a processor to calculate at least one of a installation coordinate, a number of working platforms, a number of levels of working platforms, and a deformation of an at least one selected foam mold of a scaffolding arrangement depending on at least one applied load.

According to an embodiment, the computer readable medium has stored thereon at least one of edge beam profiles data, edge beam structures data, lashing data, maximum allowable load data, load combination data, life cycle data, and stability data.

Several advantages are gained with the aid of the invention.

The structure of the scaffolding arrangement according to the invention is light, but can nevertheless be dimensioned to carry a large load, which is required for carrying the devices and materials to be used in bridge repair work. The scaffolding arrangement can be easily dismantled into parts for transportation and assembled at the point of use. Heavy lifting devices are not needed to move the parts.

The invention provides an arrangement to easily adapt scaffolding to a curving edge form regardless of the curvature. The edge may be concave, convex and/or curve upward or downward. Adjustability of the arrangement gives great flexibility. The edge molds can be made to follow the desired edge form exactly, whereby overall appearance of the finished edge has high quality. Invention also provides flat and smooth walking and working surface as well as reliable railings that enhance productivity and safety.

BRIEF DESCRIPTION OF THE DRAWINGS

In the following, the invention is described in greater detail with the aid of the accompanying drawings.

EMBODIMENTS

In the following, the downward direction is the direction from on top of the deck structure pointing towards its upper surface and the direction pointing upwards is the direction opposite to that.

Figure 1:
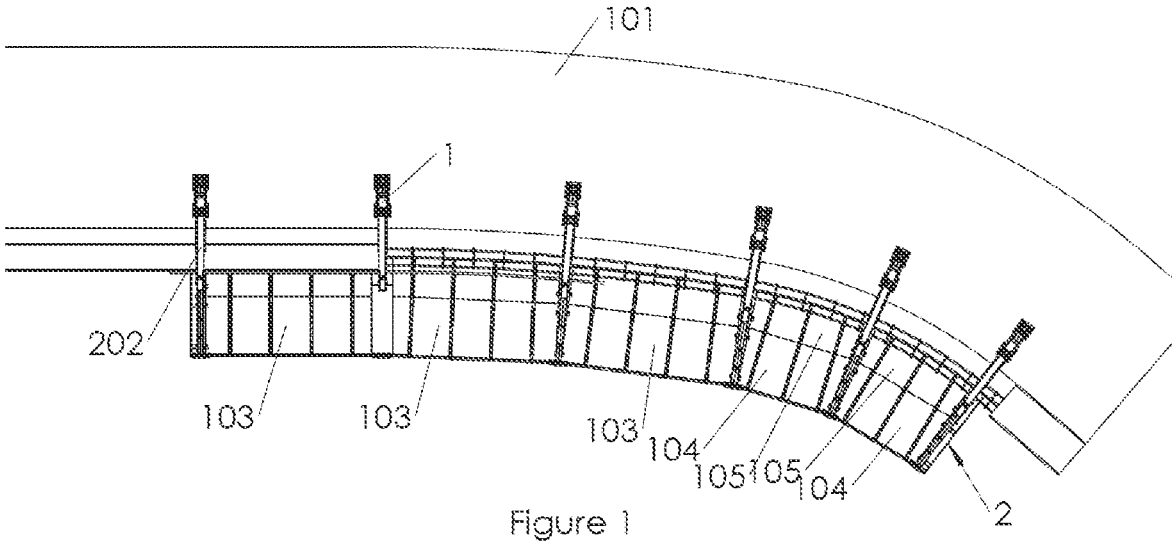
FIG. 1 shows a schematic top view of the scaffolding arrangement according to at least some embodiments of the present invention.
Figure 2:
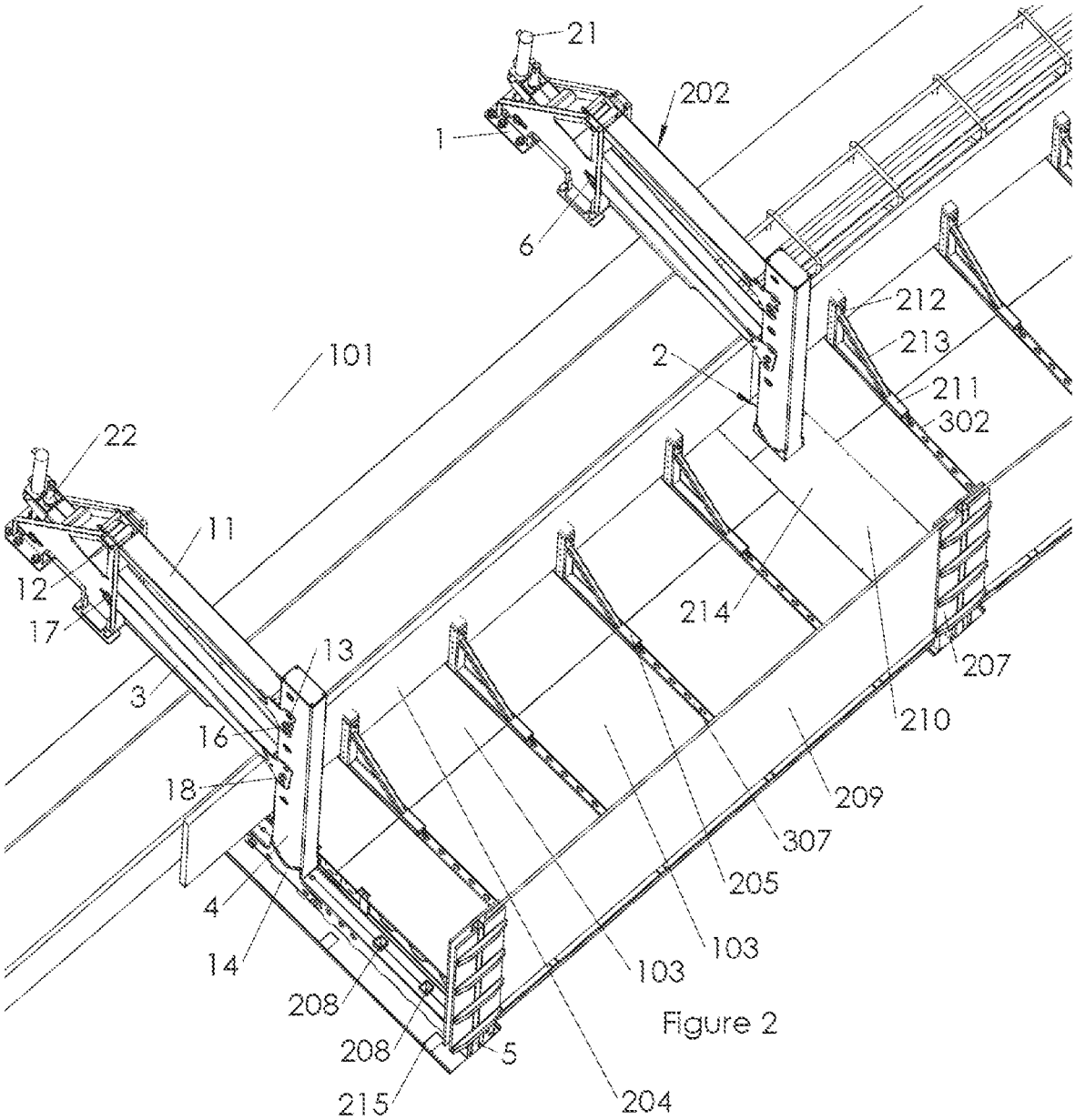
FIG. 2 is an angled view of the scaffolding arrangement of FIG. 1.

In the embodiment of FIG. 1 and FIG. 2, the scaffold 202 consists of a set of carrier arms 2 for forming work levels and for carrying the work machines and formwork required in the work and connecting the set of arms of the attachment frame 1 to the upper surface of the bridge or other deck structure 101 and for adjusting the altitude and location of the scaffolding. The set of arms 2 comprises a vertical arm 4, at the lower end of which is a transverse carrier beam 5, which forms a T-shaped structure at the end of the vertical arm. A second branch of the T is installed to point towards the deck 101, so that the opposite branch points away from the deck. Walkways for the workers and the installations required for the work machines and formwork on the deck side of the bridge can be set on these branches.

Figure 6:
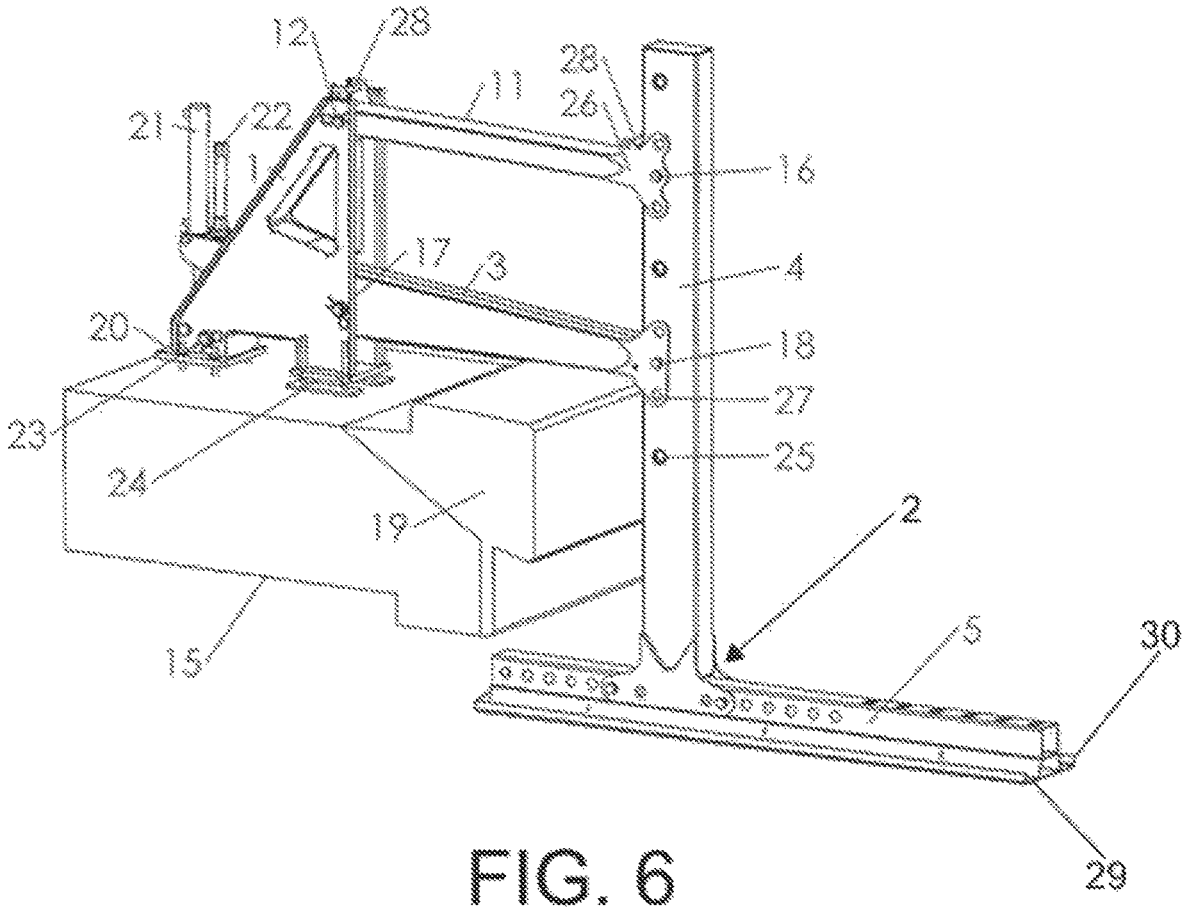
FIG. 6 shows a schematic perspective view of a scaffolding in accordance with at least some embodiments of the present invention.

One example of a scaffold for implementing the invention is shown in FIG. 6. At the opposite end of the vertical arm 4 there is a pivoted parallelogram formed by two beams, the upper beam 11 that is attached at its end to the end of the vertical arm 4 at the pivot point 16 and extends from it in the direction of the attachment unit. Under the upper beam 11 is situated a lower parallel beam 3. The upper and lower beams 3, 11 are attached to the attachment frame 1 by means of pivot pins 6 to pivot point 12 and 17 located at a distance from each other vertically, in such a way that the upper beam 11 is attached to pivot point 12 in the upper part of the attachment frame 1 and the lower beam 3 to pivot point 17 beneath it in the lower part of the attachment frame 1. In this example, the pivot points 12 and 17 of the attachment frame are on the same vertical straight line, but by altering the locations of the pivot points the paths of motion of the set of arms can, if necessary, be altered. At the opposite end, the upper and lower beam 3, 11 are attached by pivot pins 6 to lugs 13 in the end of the vertical arm 4, in which are also formed on top of each other on the same straight line in the vertical direction the pivot points 16, 18 to the upper beam 11 and the lower beam 3. Thus, the pivot points 12, 16, 17, and 18 form, together with the upper and lower beams 3, 11 a pivoted parallelogram, with the aid of which the vertical arm 4 and the transverse carrier beam 5 at its lower end can be moved vertically. The transverse carrier beam 5 is attached by pivot pins 6 to lugs 14 at the lower end of the vertical arm 14. In this attachment method, the transverse carrier beam 5 is locked to the horizontal attitude and the pin attachment is intended to create an easily assembled joint.

The attachment frame 1 can comprise attachment plates, which form a stand arrangement, which preferably includes attachment bolts that can be adjusted vertically, to attach the scaffolding to the bridge deck. The attachment bolts can be fitted into holes drilled in the bridge deck and secured with a chemical binding agent, thus making the attachment strong and reliable.

With the aid of the pivoted parallelogram, the vertical arm 4 and the transverse carrier beam 5 attached to it can be raised and lowered. In this embodiment, the operating device is a jack 21, which is installed at an extension of the lower parallel beam that extends on the other side of pivot point 17 to the deck side of the attachment frame 1. The jack 21 can be a simple screw jack, a hydraulic jack, or some similar lifting device. Because continuous adjustment of the vertical position is not needed, the jack can be a simple and strong device. The scaffold may comprise a locking device, for example a screw jack 22 for locking the position of the scaffold 202.

The scaffolding is shown in FIG. 6. The scaffolding's lower beam 3 is unified, not necessarily straight, and continues to the opposite side of the pivot point between the attachment frame 1 and the lower beam 3 relative to the vertical arm 4. The lower beam 3 thus forms a lever extending to both sides of the lower pivot point 17 of the attachment frame 1. A hydraulic jack 21 and a screw jack 22 is fitted to the end of this lever, also on the opposite side of the pivot point between the attachment frame 1 and the lower beam 3, relative to the vertical arm 4. The shafts of the jacks 21, 22 are supported on the stand 20 of the attachment frame 1. Both jacks can be used independently to adjust the position of the vertical arm 4 and the carrier beam 5 with the arm of the lever formed by the lower beam 3, but the adjustment is preferably made with the aid of the hydraulic jack while the position of the scaffolding is locked with the screw jack 22. Here, the terms hydraulic jack and screw jack refer to any hydraulic or screw-operated operating device whatever, by changing the length of which compression, or tractive force, or locking in position are achieved. The adjustment of position and locking can be done with only a screw jack if desired, but a hydraulic jack can be used as an aid in adjusting the height, or in parallel with the screw jack. Other operating devices or power tools are not required here. The adjustment can be made easily and safely on the opposite side of the attachment frame to the bridge deck. The lever can also be formed in a corresponding manner in the upper beam 11 or in both beams 3, 11. It is then possible to optionally fit either of the jacks to the upper beam and the other to the lower beam or both in connection with either the lower beam or upper beam.

The scaffolding unit (attachment frame 1) is preferably attached to the deck of the bridge or other structure with the aid of screwed bolts 23 from the stand 20. Attachment to the deck takes place by gluing or casting the bolts into blind holes made in the deck. The attachment is made from two stands 20 at a distance from each other and with the aid of the screwed bolts the scaffolding can be raised from the deck, so that a gap 24 forms between the scaffolding and the deck. The deck surface can then be worked on and the surface cast with the scaffolding attached. There can be a spirit level or spirit levels ready in the attachment frame to facilitate the adjustment of its position.

In this embodiment, the positioning of the scaffolding unit in the height direction relative to the deck of the bridge or other structure takes place by altering, in addition to the pivoted parallelogram, the locations of the attachment points (pivot points) 16 and 18 between the vertical arm 4 and the pivoted parallelogram 12, 16, 17, 18. In the vertical arm 4 there are attachment holes 25 on top of each other, which have a predefined distance between them. At the ends of the upper and lower beams 11, 3 there are lugs 26, which are arranged on both sides of the vertical arm and in which there are also attachment holes 27 on top of each other, which have a predefined distance between them. The distances between the vertical arm's attachment holes 25 are greater than the distances between the lugs' 26 attachment holes 27. In this way, a large adjustment margin is obtained with the aid of the vertical arm's 4 attachment holes 25 and a smaller adjustment margin with the aid of the lugs' 26 attachment holes 27. When this manner of adjustment is combined with the adjustment taking place with the aid of the pivoted parallelogram, the position of the scaffolding unit can be set precisely as desired within quite large limits. This permits, among other things, easy and accurate placing of the bridge's edge casting 19.

Figure 5:
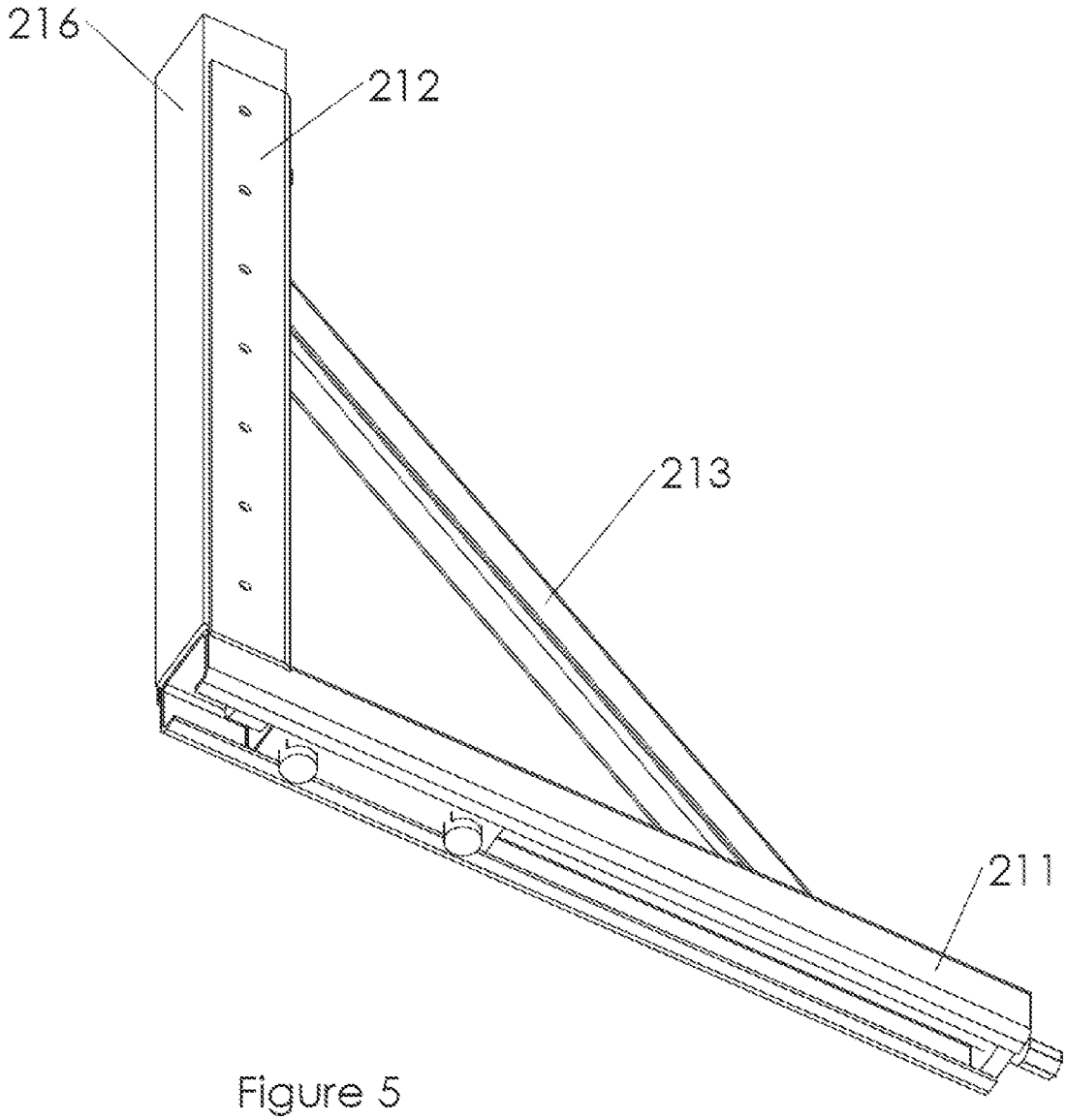
FIG. 5 shows scaffolding that may be used to implement the invention.

The adjustment of the position of the carrier beam 5 relative to the edge of the bridge deck or other structure can be carried out with a corresponding hole distribution. FIG. 5 shows a dense hole distribution in the carrier beam 5 and four holes in the attachment lugs of the vertical arm. This hole distribution is also flexible and the number and distribution of the holes can be altered to create an adequate adjustment precision. Though a dense hole distribution can also be made in the long load-bearing components such as the vertical arm or the carrier beam, in these it is preferable to use a larger hole distribution, to minimize the number of holes and preserve strength.

In the scaffolding, a pivoted parallelogram is preferably used, but the lengths of the sides and the location of the pivots can be altered as required, making it a pivoted rectangle.

In FIG. 1 the scaffolding described above is used for making a scaffolding arrangement according to the invention. It is only one possible type of scaffolding and may be replaced with other support scaffoldings. However, the easy height adjustment provides benefits when combined with the invention, whereby the above described scaffolding type is preferred, The arrangement according to the invention is mounted on an edge of a deck 101 and the edge has a straight part and a curved part. The working and walking surface and support for edge mold 204 is formed by set of platforms. The platforms are formed of profiles 303, 304 and 305 that form a load bearing structure of the platform and panels 301 and keyhole profiles.

Figure 3:
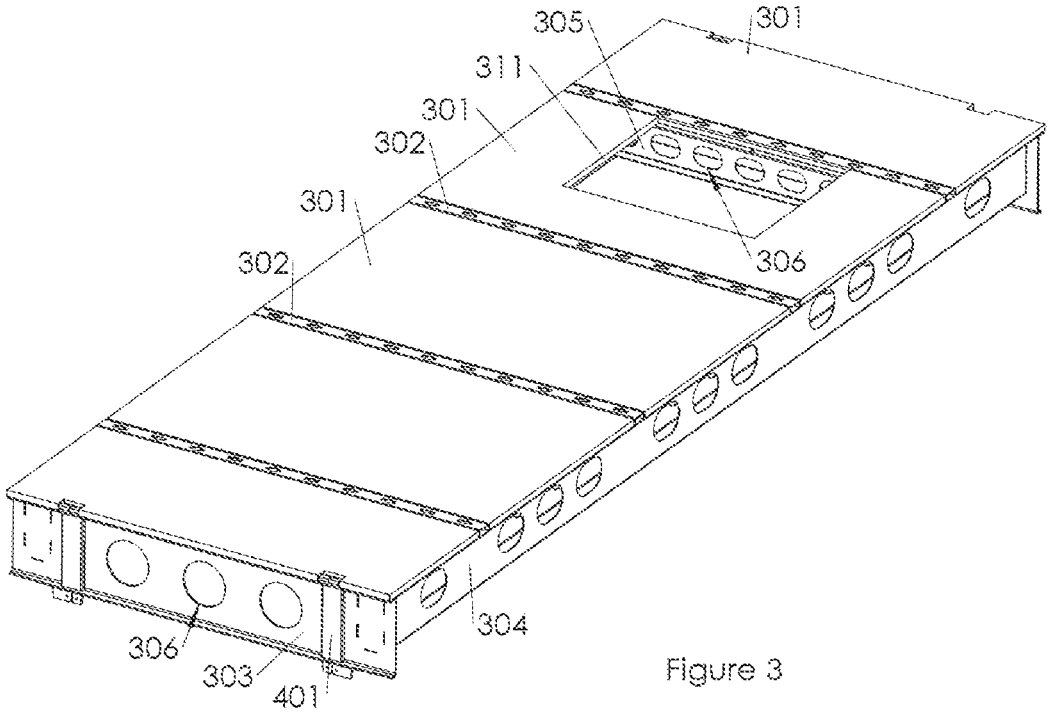
FIG. 3 shows a detail of FIG. 1 and FIG. 2.

One embodiment of a platform is shown in FIG. 3. The upper surface of the platform consists of replaceable panels 301, which may have various shapes according to end angles of the platform. Preferably the panels are rectangular and in panels having angled ends, panels having a form of cut triangle are used. Between each surface panel are keyhole profiles 302 for attaching mold supports, tools, railings and such. The keyholes 307 are preferably symmetric to enable using the platform either long side towards the edge of the deck. The keyholes 307 comprise a hole 405 and cuts 406 on both sides of the hole 405 in longitudinal direction of the keyhole profile 302. The keyholes 307 function as locking elements so that a mushroom shaped pin may be inserted through the hole 405 and pushed into one of the cuts 406, whereby the pin is locked by the edges of the cut 406.

Platforms have a frame comprising end profiles 303 with protruding lower edges 308 to prevent them sliding of the scaffold carrier beam shelves 29 that have turned edges 30 for holding the protruding lower edges when they are mounted on the carrier beam shelves 29. Longitudinal profiles 304 provide support to panels 301, keyhole profiles 302 and transversal stiffeners 305. Keyholes 307 may also be cut straight to the transversal stiffeners, depending on the chosen profile shape. All profiles may have weight saving holes 306. Locking mechanism guides 401 are attached to the end profiles.

Some panels may have openings for forming man holes 311 with covering hatches for access the working surface and for exit therefrom as well as for other lead-throughs for hoses and cables. Tool boxes may be integrated in the profiles. Platform profiles can be made of metallic materials like aluminum or steel, bended plates, profiles or extrusions, wood, reinforced plastics or their any suitable combination. Some surfaces may be covered with plastic or elastomer materials. Some preferable panel materials are plywood and aluminum extrusions.

The edge of a deck 101 can be straight or curved inwards or outwards. The deck can be horizontal or angled to rise in any direction. In order to accommodate to these various edge shapes, the edge platform system according to the invention comprises scaffolds 102 and preferably two types of platforms 103, 104 and 105. One type of platform is rectangular having straight edges and ends. Such a platform is depicted in FIG. 1 by reference number 103. Another type of a platform has angled ends. This type of platform 104, 105 is formed as isosceles trapezoid. In this embodiment the space between two adjacent scaffolds 202 is covered by two platforms, one placed at the edge of the deck and extending under the edge and one covering the distal area of the edge. At the straight part of the edge, where rectangular platforms may be used, the platforms may have same dimensions. However, at the curving part the dimensions of the platforms 104 and 105 have to be matched so that the end edges of the platforms are aligned. In such case the platforms covering the distal area from the edge of the deck are smaller and their longer straight edge must have approximately same length as the shorter edge of the panel placed at the edge.

Platform lengths may have varying lengths. As described above, inner and outer platforms with angled ends should have matched lengths. All platforms can be rigged to both concave and convex orientations, as well as straight platforms can be used either way either long edge facing towards the edge of the deck for ease of rigging. The distance between keyholes 307 in the profiles 302 is set so that the spacing between the keyholes 307 remains the same over the edge of the platform. Keyhole spacing remains constant over the joint of the platform pair, enabling choice any position for the mold supports.

Figure 4:
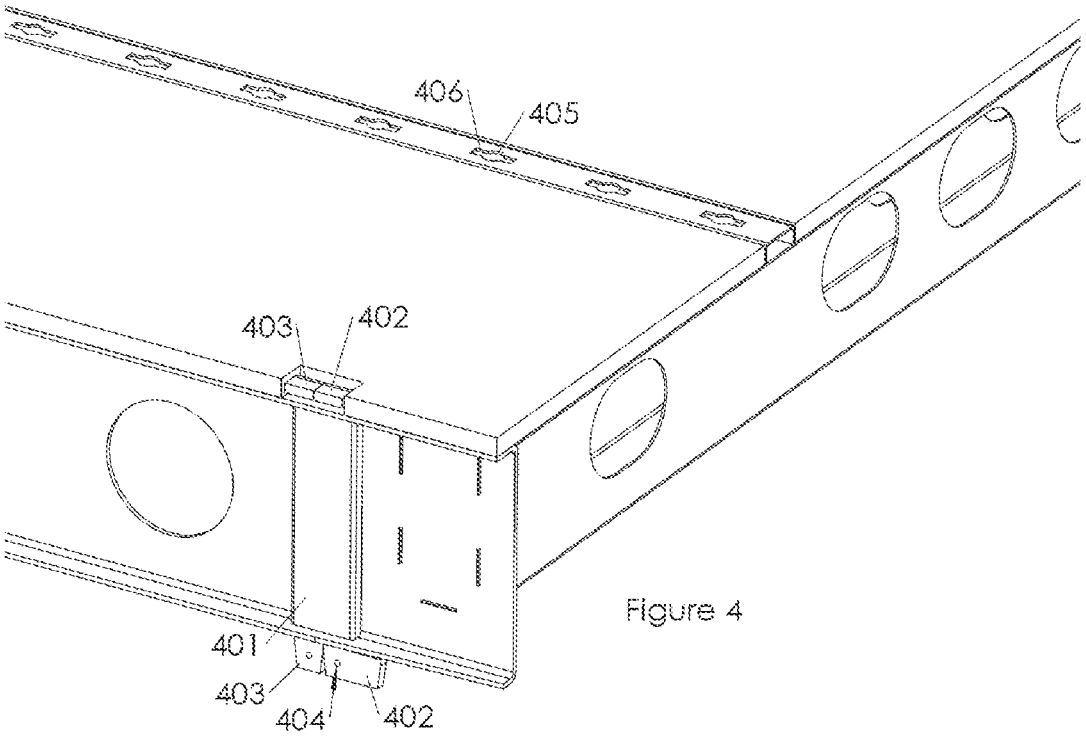
FIG. 4 shows a detail of FIG. 1 and FIG. 2.

Straight ended platforms 103 can be adjusted from straight line to small angles inwards and outwards in relation to the edge of the deck and the carrier beam 5 of the scaffolds 202. Thus small curvatures and deviations in the shape of the edge can be accommodated by simple adjustment. This adjustment is accomplished by allowing small play in the locking mechanism (401-404, in FIG. 4) for locking the platforms 103. 104, 105 to carrier beams 5 of scaffolds that allow enough play so that the platform can be tilted in relation to the longitudinal axis of the carrier beam. The play should enable adjustment of at least for 1-3° from the longitudinal axis of the carrier beam.

The arrangement may include multiple sets with varying end angles of platforms having angled ends. Preferable angles for sets are such that platforms having smallest angle between the straight edges and the ends, have a minimum rigging angle that matches maximum rigging angle of a straight ended platforms, and their maximum rigging angle corresponds to the minimum of the next, more angled set. Thus, the adjustment angle provided is always a sum of adjustment provided by the play in locking mechanism and the actual angle of the platform. This way large variety of all possible angles both inwards and outwards can be covered with few sets having correctly chosen fixed end angles.

In FIG. 2 a deck 101 has scaffolds 202 attached to the upper surface. Platforms 103, 104, 105 can be rigged alone between scaffolds or in pairs as described above, depending on demand of work space. The FIG. 2 shows also an edge mold 204 that is supported with adjustable brackets 205 that are fixed on keyhole profiles 302. Their distance from deck/bridge edge can be adjusted by moving the brackets 205 in the holes 307 to enable casting curved mold shapes. The brackets comprise a foot 211 having locking elements for gripping the keyholes 307 and a push beam 212 extending in a straight angle from the foot 211 and a strut 213 connecting the distal ends of the push beam 212 and the foot 211. The push beam 212 is formed of a U-profile and filled with a wooden insert for attaching to the mold 204. The curvature of the mold 204, or in particular the wall of it, can be changed simply by moving the positions of the brackets 205 on the keyhole profiles 302. Further adjustment possibilities may be provided by joining the foot and the push bar 212 by a joint or a hinge and making the length of the strut adjustable. This would provide angular adjustment for the push bar 212. Further, the foot may be provided with a slide or an adjustment screw or functionally similar actuator to provide fine adjustment of the position along the keyhole profile 302. In the embodiment of FIG. 5 the foot is made of C-profile and two locking elements are mounted on a slide, that is adapted to move within the C-profile. The position of the slide in relation to the bracket is adjustable through a screw mounted on the slide and extending from the distal end of the foot. This system with keyholes and adjustment screw provides step less adjustment of the position of the bracket.

The position of the mold, the scaffolding and working area may be adjusted by using the adjustment possibilities of the scaffolds 202. Thus the arrangement can be adjusted to suit any rising or descending curvature or angle.

Railing posts 207 can be rigged on multiple locations on mounting holes 208 made on carrier beams 5, depending on the work space requirements. The railing posts 207 have a cross section of letter H wherein the flanges of the H form slots for supporting railing plates 209, which can also take support from the keyholes profiles 206 by brackets or similar elements. The railing plates 209 or other railing elements are preferably dimensioned so that the railing plates 209 fit loosely between the railing posts, as can be seen from FIG. 2. This enables forming the scaffolding arrangement that curves upwards, downwards or rises or descends.

Open spaces between platforms are covered with plates 210 to prevent cutting waste, tools, fresh concrete or other dangerous items or items causing harm from possibly falling down. The cover plate may be provided as a length of plate having slots 214 at each end. The slots are dimensioned so that when the plate is cut to length, the slots together can be fitted around the vertical arm 4.

Locking mechanism for attaching the platforms to carrier beams comprise a lock guide 401 formed at the end profile of a platform. A locking hook 402 can be slid into the guide 401. When a locking hook 402 has passed through a hole 215 in the scaffolds carrier beam 5, it slides sideways when locking nail 403 is pushed into the guide 401 next to it. This prevents the locking hook 402 to slide back to opening position and secures the locking hook 402 to the shelve 29 of the carrier beam 5. Both locking hook 402 and locking nail 403 may have securing holes 404 in suitable locations. As described above, the locking mechanism should provide enough play to allow angular adjustment of the platforms. This can be accomplished by suitable dimensioning of any part of the mechanism, but preferably and simply this is done by dimensioning the hole 215 in the scaffolding carrier beam shelf 29 so that it allows the desired movement. The carrier beam flange 29 is dimensioned wide enough so that the end profiles 303 with protruding lower edges 308 of the platform may be tilted when they are resting on the shelf in order to allow adjustment of the angle of the platform. The entire locking mechanism is protected from environment and dirt with platform covering plates 210. The carrier beam shelf 29 may include end stoppers for preventing the platform to slide from the shelf 29 in lengthwise direction.

The features of the scaffolding arrangement described above can easily be combined and the corresponding components replaced with each other in order to create a structure more suitable for its purpose.

The platforms may have other shapes than those described above. The system may comprise a platform having one straight end and one angled one or ends with different angles. It can be contemplated that edges of the platforms have other shape than straight, but such design would have limited variability and thus its use might be limited to special tailored uses only.

In the scaffolding, there can be integrated working stages and these can include rails or attachments for formwork, tools such as abrasive water jets, or handrails. The scaffolding can be attached to a rail in the bridge deck, so that it can be moved as work progresses parallel to the deck. In the attachment components there can be toolboxes for the safe storage of tools and other materials and lifting hooks or similar can be installed in the scaffolding so that it can be moved as an entire system.

The scaffolding unit according to the invention can be transported to the work site ready assembled or dismantled into its principal components. Assembly of the scaffolding unit takes place simply by installing the pivot pins 6 in place and locking them with cotters. Thus in principle, the assembly of the scaffolding unit requires no tools at all. The scaffolding unit is easily dismantled into relatively light parts and can be moved to a new location after use. Because several scaffolding units are required for a bridge deck or similar work site, significant advantages are achieved with the aid of easy assembly, disassembly, and transportation. In place of pivot pins and cotters it is possible, of course, to use other corresponding attachment elements such as bolts and nuts.

Figure 7:
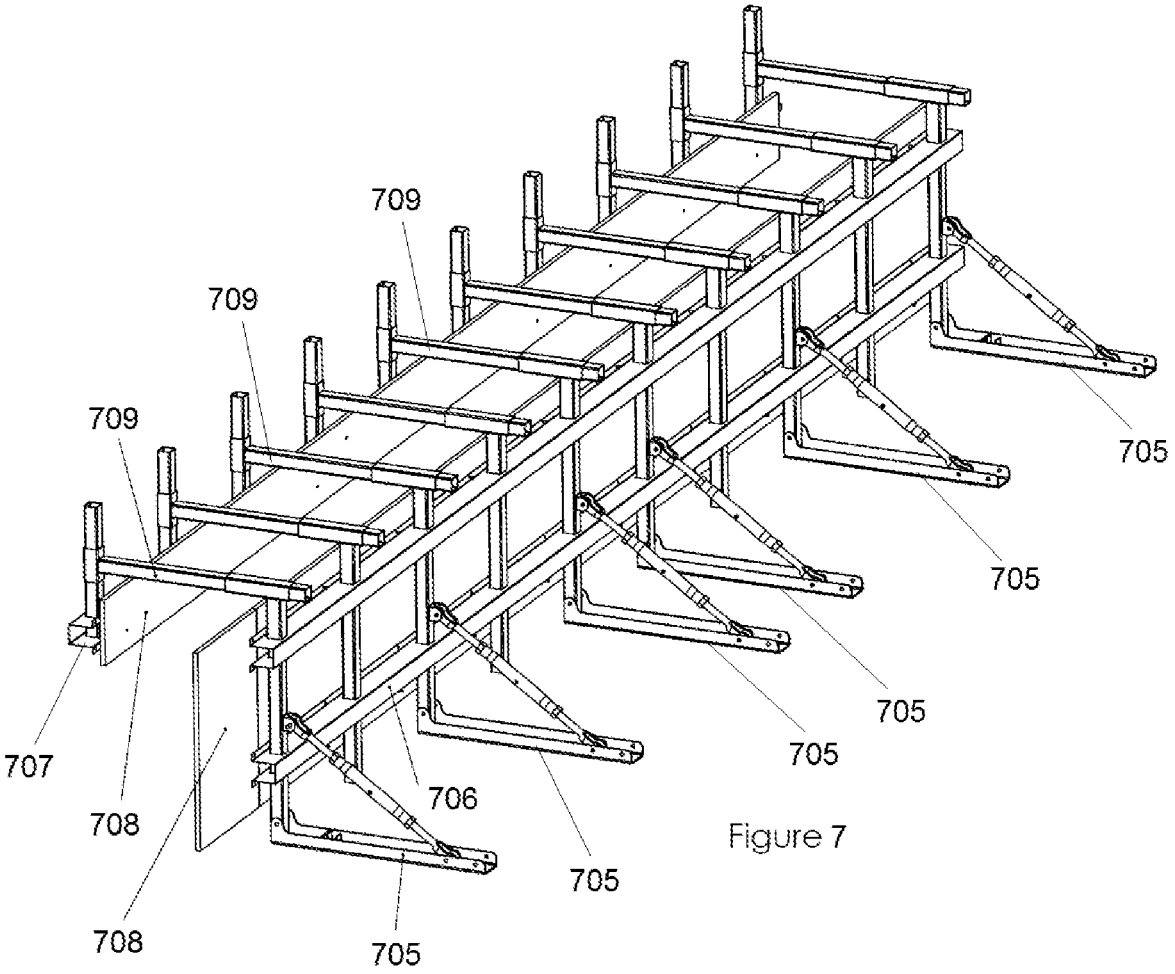
FIG. 7 illustrates a schematic perspective view of a scaffolding arrangement in accordance with at least some embodiments of the present invention.

In FIG. 7 a schematic perspective view of a scaffolding arrangement in accordance with at least some embodiments of the present invention is illustrated. The arrangement comprises an outer mold 706, an inner mold 707, brackets attached to the platforms (not shown), and intermediate pieces 708 in both outer and inner mold 706, 707. The outer mold 706 and the inner mold 707 are connected to each other via adjustable supports 709. Support spacing depends on the beam profile of the supports 709. Profiles generating high mold forces require short spacing.

Figure 8:
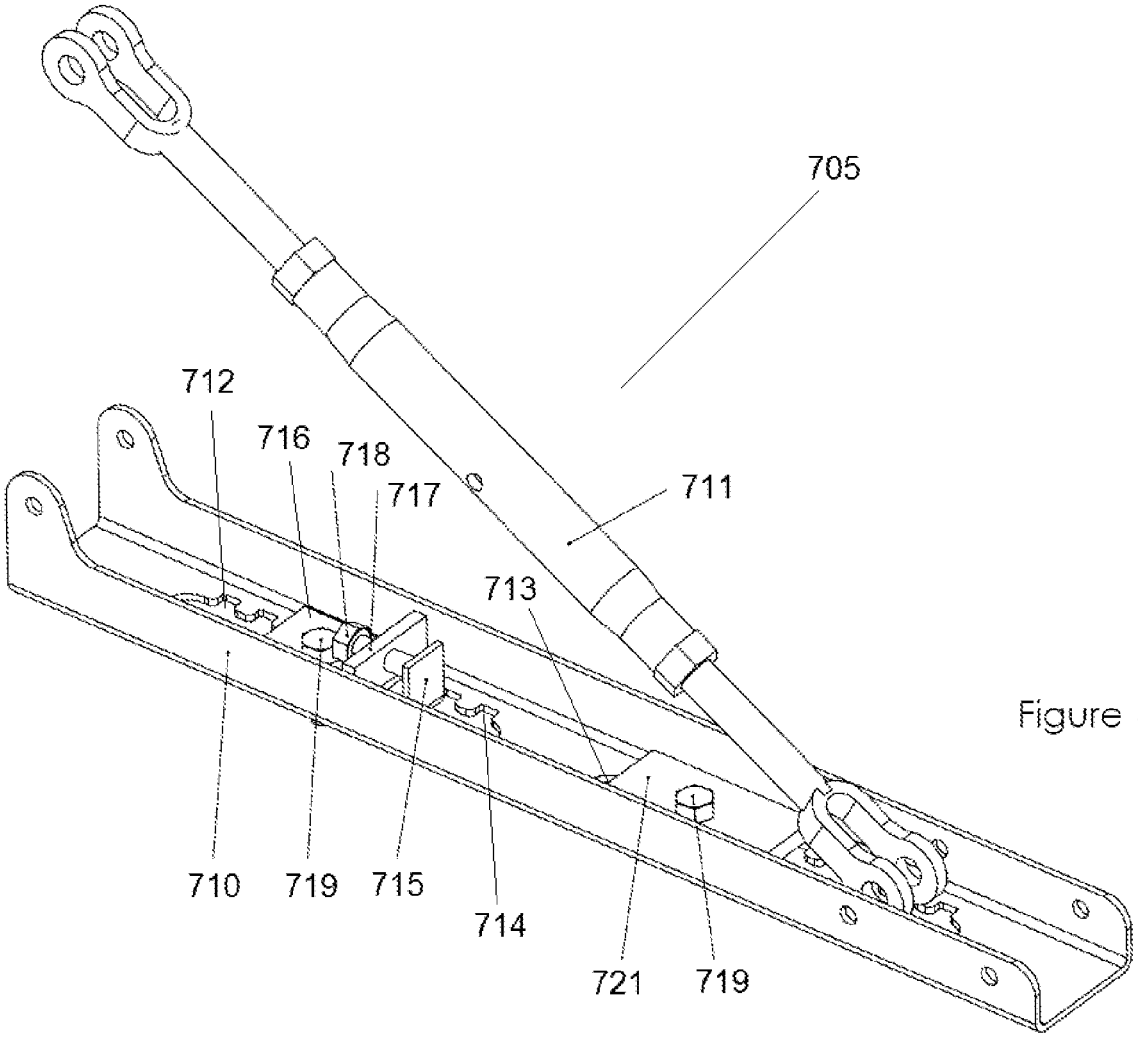
FIG. 8 illustrates a schematic perspective view of a bracket of a scaffolding arrangement in accordance with at least some embodiments of the present invention.
Figure 9:
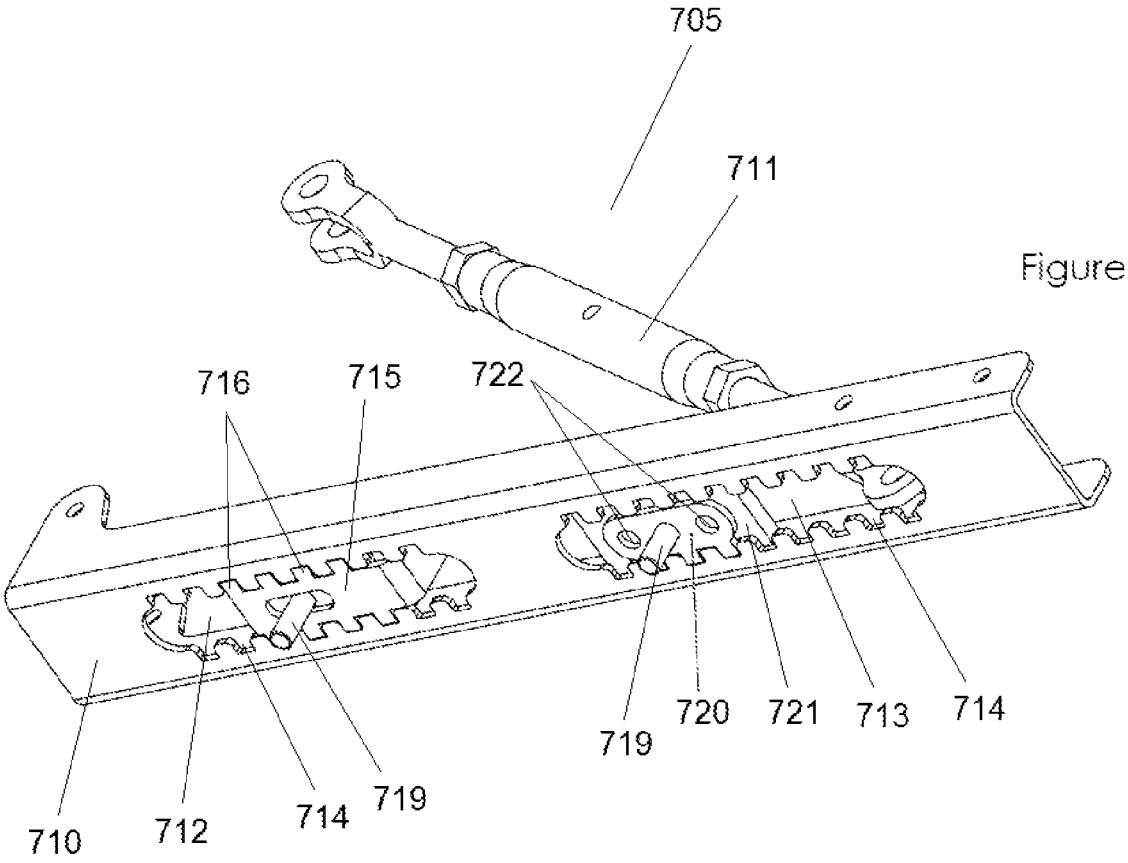
FIG. 9 illustrates a schematic perspective view of a bracket according to FIG. 8 of a scaffolding arrangement in accordance with at least some embodiments of the present invention.
Figure 10:
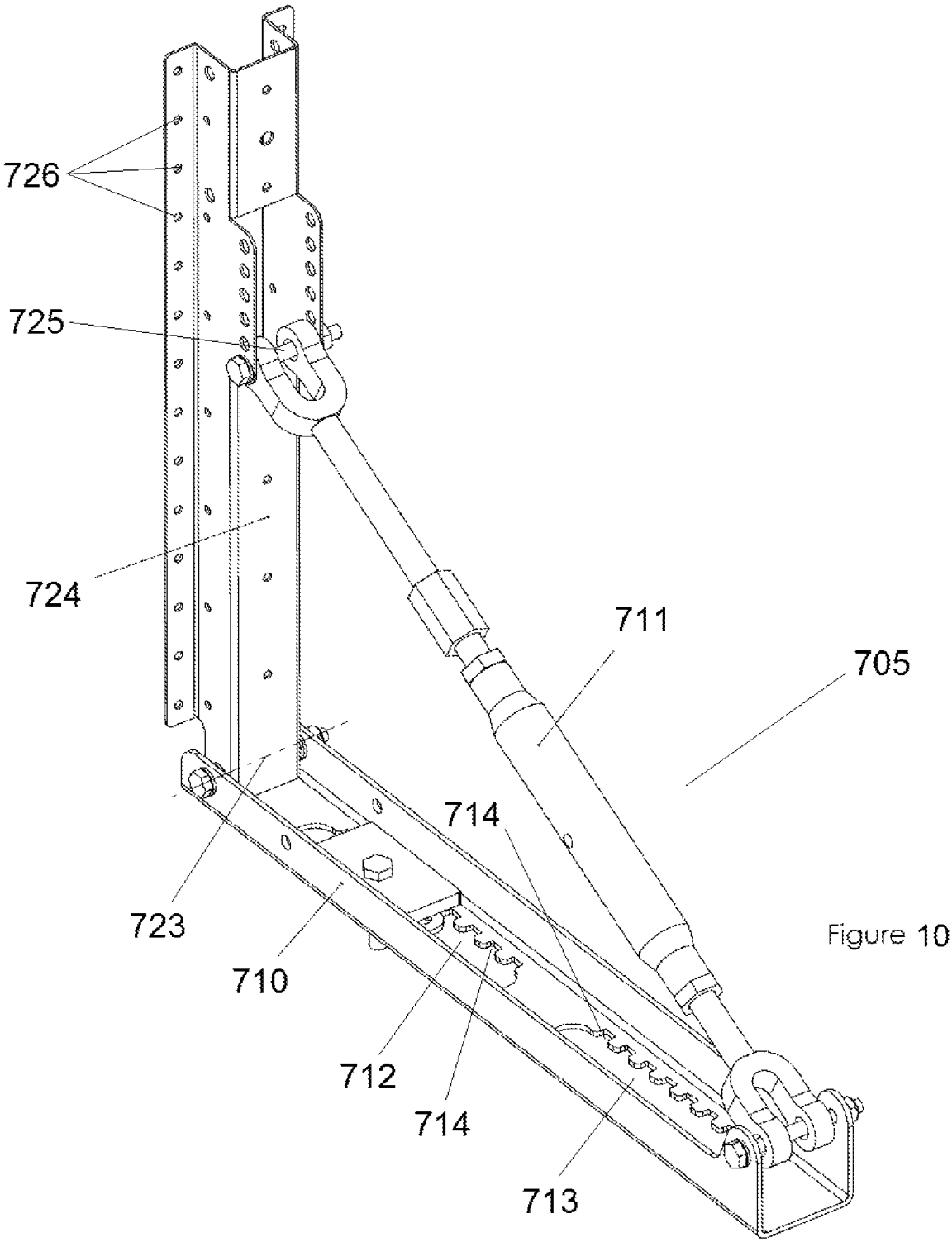
FIG. 10 illustrates a schematic perspective view of a bracket of a scaffolding arrangement in accordance with at least some embodiments of the present invention.

The scaffolding arrangement comprises adjustable brackets 705 which can be e.g. mounted on keyhole profiles 302 (not shown) or holes in a platform. Their distance from deck/bridge edge can be adjusted by moving the brackets 705 in the holes 307 (not shown) to enable casting curved mold shapes. Details of such adjustable brackets 705 are shown in FIG. 8, FIG. 9, and FIG. 10.

There are several methods for arranging the bottom side mold for the edge beam. In addition to conservative wood construction, it can be made using components similar to the outer mold 706 and the inner mold 707 including brackets similar to the brackets of the inner mold 707. A third option is to use extruded foam blocks combined with some of the presented mold components to create a precise shape of the bottom side.

A practical way of installing the vertical molds is to have only the endmost supports present, which allows easy adjustment to the vertical mold and add mode supports later on.

The outer mold can be a construction of a mold skin plate with stiffeners, it can be a massive plate, any type of glued wood construction, sandwich structure or loose timber planking, depending on the shape of edge beam.

The back mold support arms 709 allow both horizontal and vertical movements, enabling continuous edge beam shape alterations and any dimensions without additional fillers.

The leg profiles 710 of the brackets 705 can be turned flat for transportation by removing either end pin of the rigging screws 711 and folding the screws 711 and leg profiles 710 against the mold 706.

The inner mold supports 709 can be lifted loose for transportation, as well as the inner mold 707.

In FIG. 8 a schematic perspective view of a bracket 705 of a scaffolding arrangement in accordance with at least some embodiments of the present invention is illustrated. The adjustable bracket 705 comprises a leg profile 710, a rigging screw 711 for vertical angle adjustment, and two locking devices. The leg profile 710 comprises two openings 712, 713 which are orientated along the leg profile 710 and may include grooves 714 at two sides of each respective opening 712, 713.

The first locking device comprises a key plate 715 including tongues 716 as shown in FIG. 9 which are configured to be connected to the grooves 714 of the opening 712. The first locking device further comprises a first sledge 716 including a pressing plate 717 and an adjustment screw 718 for positioning the sledge 716 in relation to the key plate 715 by means of varying a distance between the key plate 715 and the pressing plate 717. The sledge further comprises a screw or bolt 719 for connecting the bracket 705 e.g. to a keyhole profile or a platform.

The second locking device may be designed as the first locking device or may comprise a fixed tooth key 720 including multiple holes 721 as shown in FIG. 9 for insertion of a screw or bolt 719. The spacing is depending on the pitch of the tongues of the tooth key 720. A second sledge 721 is attached to the tooth key 720 via the screw or bolt 719 for connecting the bracket 705 e.g. to a keyhole profile or a platform.

In FIG. 9 a schematic perspective view of a bracket 705 according to FIG. 8 of a scaffolding arrangement in accordance with at least some embodiments of the present invention is illustrated. The grooves 714 of the openings 712, 713 may have a different phase on opposite sides of the respective opening 712, 713 and/or may also have a phase difference between the openings 712, 713 in order to allow fine fixed pitch adjustments depending on the position of the fixed tooth key 720 on any of the four possible sides. Further, any of the multiple bolt holes 722 may be used for the screw or bolt 719 of the second locking device. Of course, also the first locking device may be equipped with a tooth key.

In FIG. 10 a schematic perspective view of a bracket 705 of a scaffolding arrangement in accordance with at least some embodiments of the present invention is illustrated. In case that the connection between the rigging screw 711 and the push beam 724 is interrupted by removing the pin 725 of the rigging screw 711, the leg profile 710 can be rotated about an axis of rotation 723 relative to the push beam 724 such that the bracket 705 can be folded for easy transportation. The push beam 724 is then partially arranged inside the leg profile 710 and the rigging screw 711 can then be arranged inside the profile of the push beam 724.

The push beam 724 further comprises a plurality of borings 726 for attachment of the bracket 705 to wooden planking (not shown), plywood (not shown), or other laminated plate structures (not shown).

The first locking device and the second locking device each comprise an opening 712, 713 including grooves 714. Both locking devices can be equipped with a tooth key 720.

Figure 11:
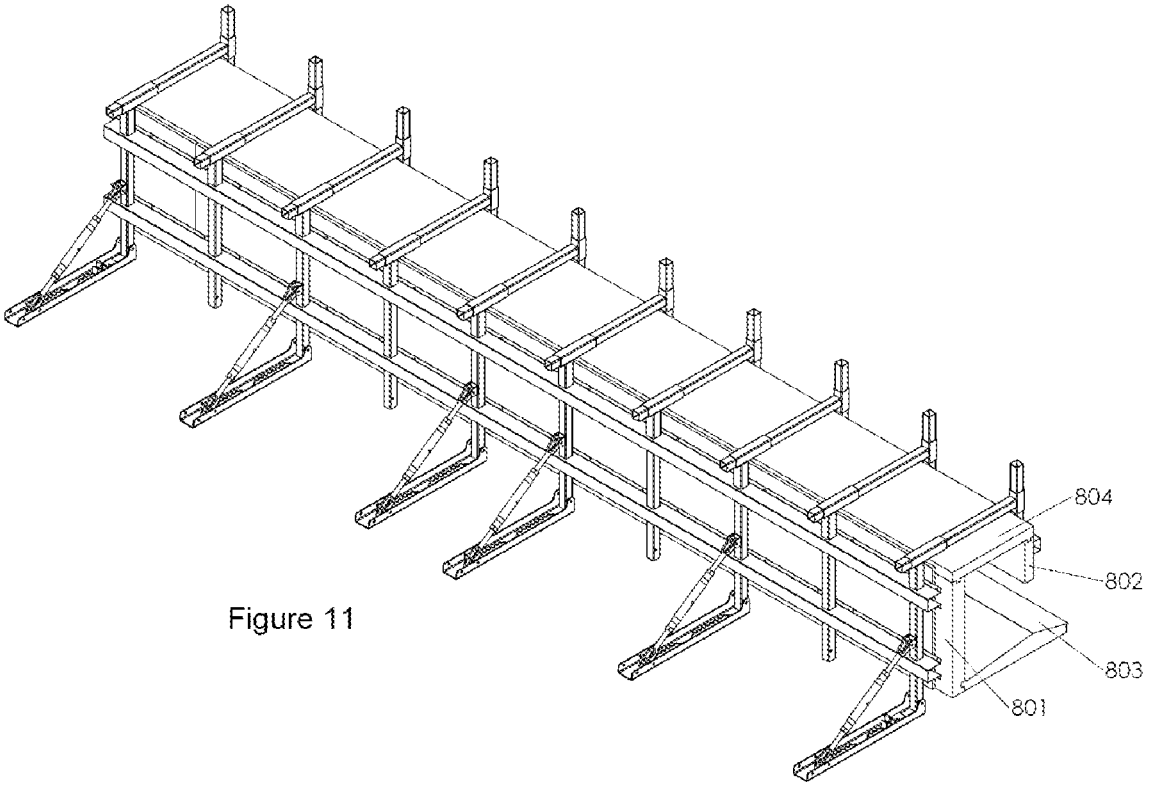
FIG. 11 illustrates a schematic perspective view of a mold of a scaffolding arrangement in accordance with at least some embodiments of the present invention.
Figure 12:
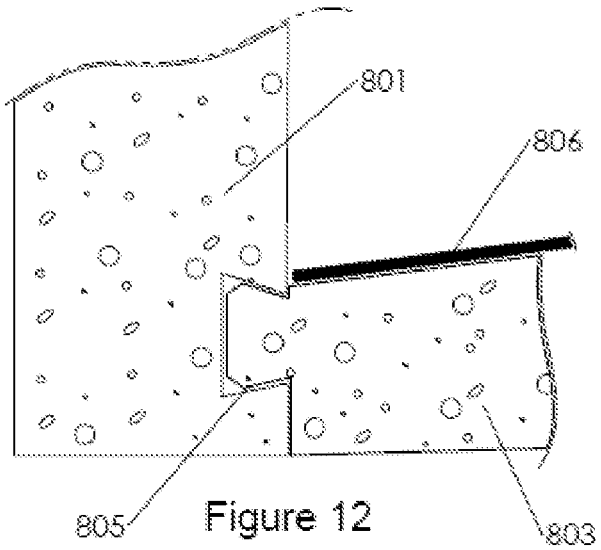
FIG. 12 illustrates a schematic cross-sectional view of a locking mechanism of foam parts of a mold of a scaffolding arrangement in accordance with at least some embodiments of the present invention.

In FIG. 11 a schematic perspective view of a mold of a scaffolding arrangement in accordance with at least some embodiments of the present invention is illustrated. A foam lining comprises different foam profiles 801, 802 and a foam bottom mold block 803. In cold environments the mold can be additionally closed with a top foam profile 804.

A foam mold provides many advantages compared to current technology. The foam parts of the mold can be industrially prefabricated in factories. The foam parts can further be processes with mobile cutting machines and even with manual tools. The weight of the foam parts of the mold is substantially less than the weight of corresponding wooden parts, plywood parts, or metal parts, thus improving the handling of the parts. Further, the foam material can be recycled. Furthermore, the foam parts provide advantageous thermal insulation properties. The foam parts enable casting in low temperatures without heating. Since the water absorption is small compared to wood, a more preferable water-cement-ratio can be achieved.

Figure 13:
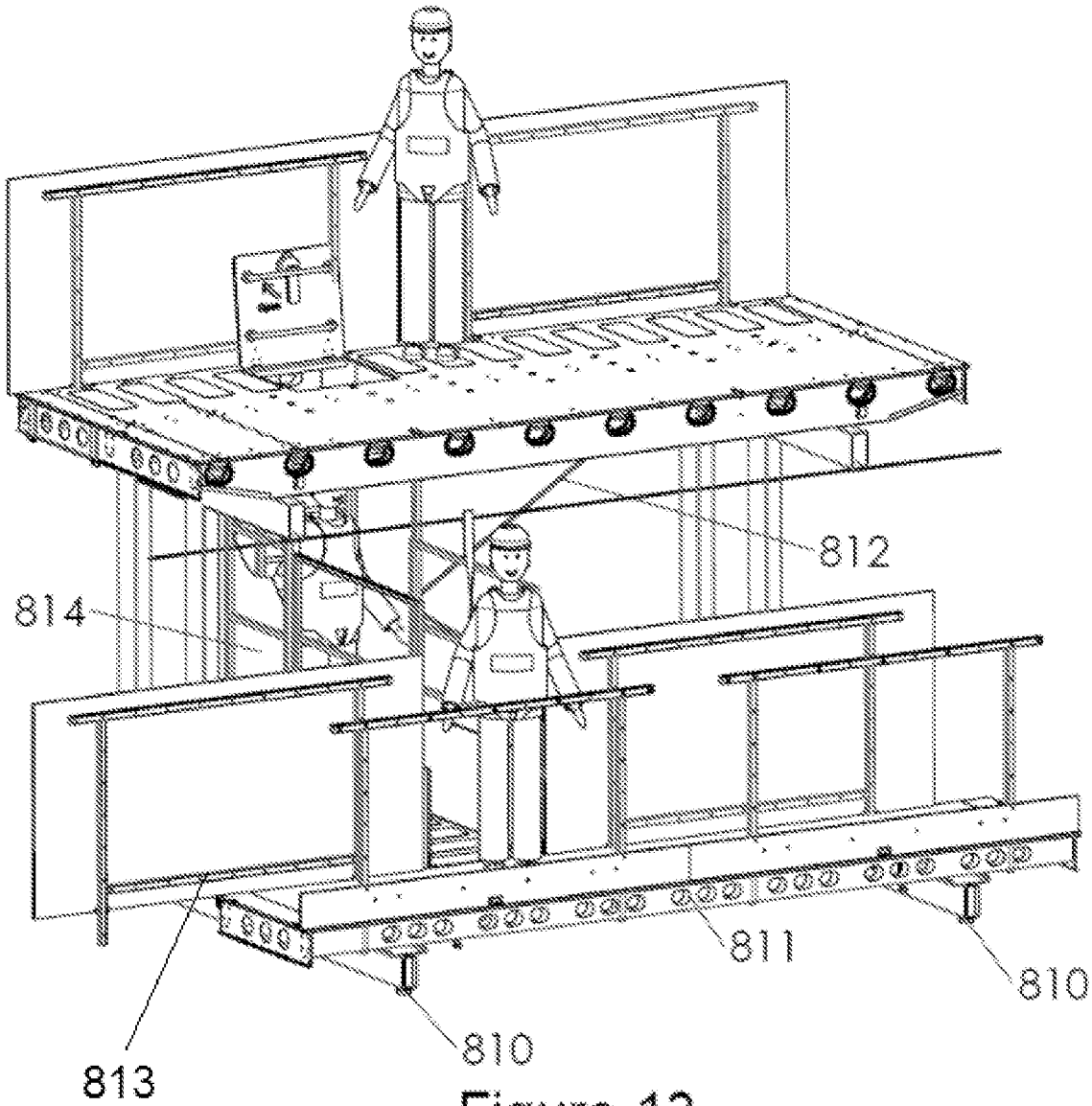
FIG. 13 illustrates a schematic perspective view of working platforms of a scaffolding arrangement in accordance with at least some embodiments of the present invention.

In FIG. 13 a schematic cross-sectional view of a locking mechanism 805 of foam parts 801, 302 of a mold of a scaffolding arrangement in accordance with at least some embodiments of the present invention. A first foam parts 801 provides at least one indentation, groove, hole, or similar. A second foam part 803 provides a tongue or similar which is configured to be inserted into the indentation, groove, hole, or similar. The tongue or similar of the second foam part 803 can snap into the first foam part 801 due to the flexibility of the foam material. Of course, also other types of locking devices can be used such as separate locking profiles, rails, bosses, nail plates, or spikes penetrating into the foam parts. Some foam parts can also be fixed with adhesives, glues, or bindings. At least some kind of fixing of the foam parts is typically necessary in order to prevent them from getting afloat during casting.

In specific cases having high surface contact pressures, the foam block surfaces can be protected by a relatively thin reinforcement layer 806 of a film or clothing. Of course, also a hard plate or sheet of suitable material can be used. Typically, recyclable material is used.

In FIG. 13 a schematic perspective view of working platforms 811 of a scaffolding arrangement in accordance with at least some embodiments of the present invention is illustrated. The working platforms 811 can be equipped with horizontally and vertically adjustable legs 810 which support the lower deck platforms 811. The lower deck platform 811 can be e.g. used for bridge, deck, or other target underside maintenance work. The legs may have diagonal stiffeners 812 and can carry the working platform 811 with railings 813 and other outfitting during assembly.

Figure 14:
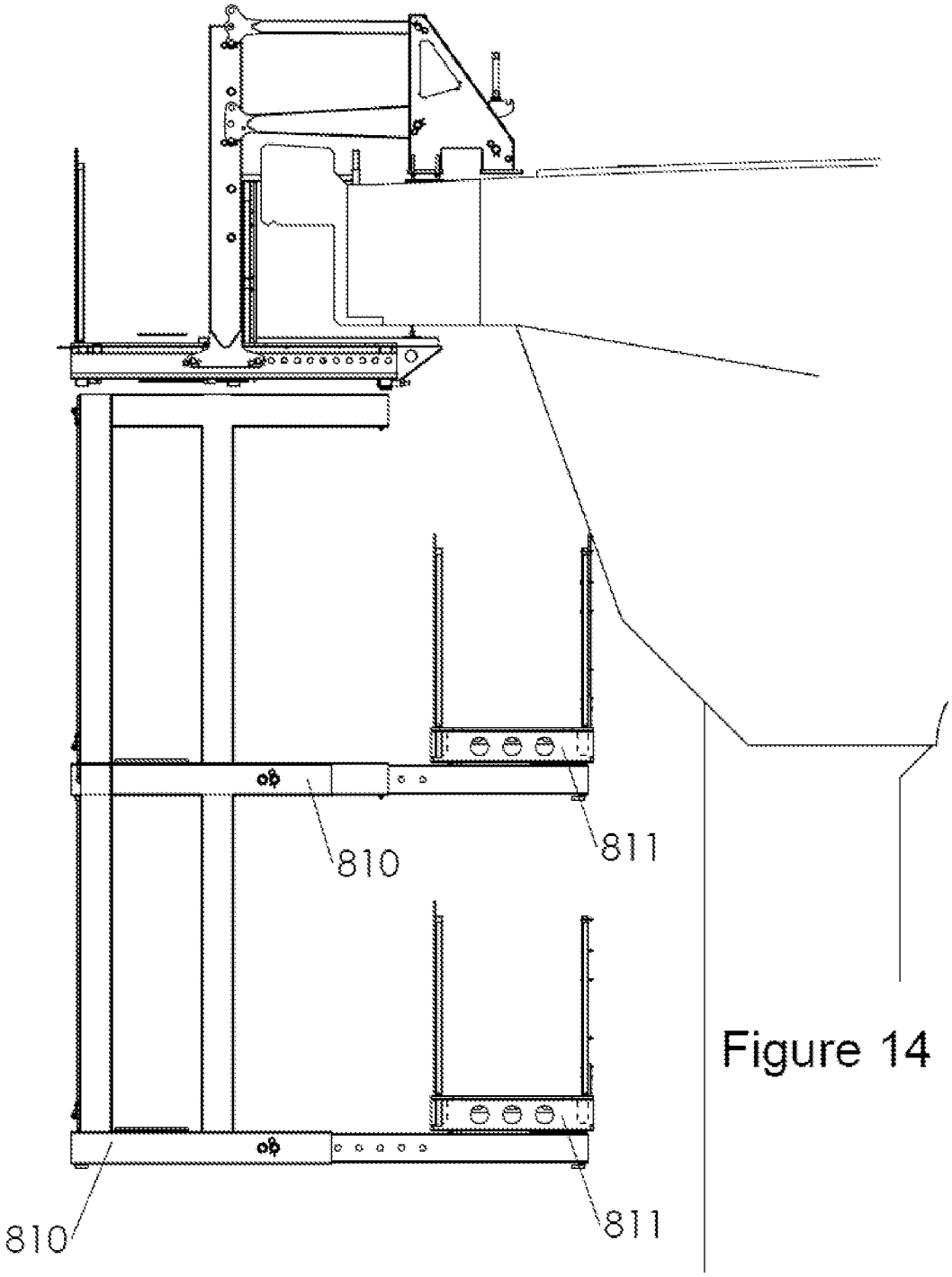
FIG. 14 illustrates a schematic side view of working platforms of a scaffolding arrangement in accordance with at least some embodiments of the present invention.

In FIG. 14 a schematic side view of working platforms 811 of a scaffolding arrangement in accordance with at least some embodiments of the present invention is illustrated. The lower working platforms 811 may be more lightweight than other working platforms. In some applications the lower level decks of platforms 811 with legs 810 may be arranged cascaded into a platform stack. The legs 810 can be adjustable, thus reducing the dimensions of the assembly, if required.

Figure 15:
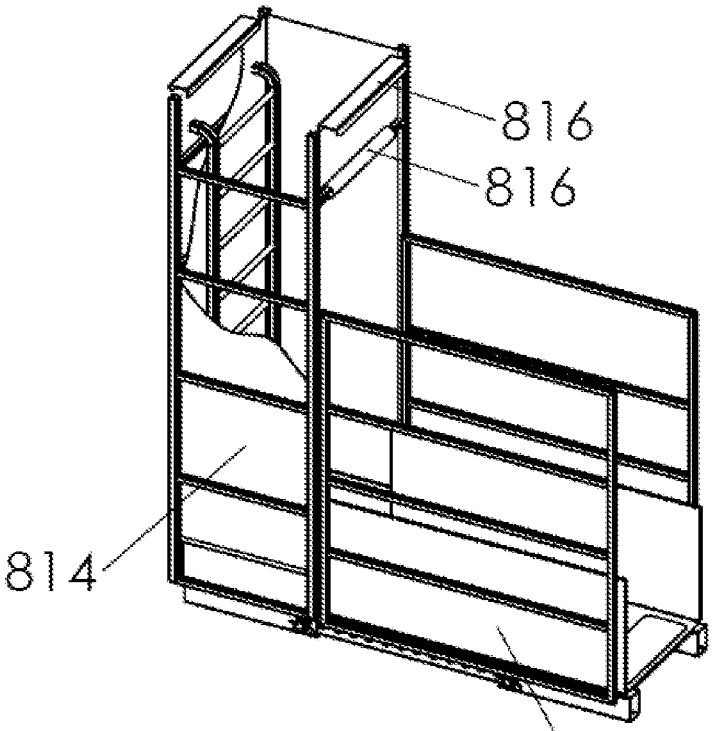
FIG. 15 illustrates a schematic perspective view of a manway of a scaffolding arrangement in accordance with at least some embodiments of the present invention.

In FIG. 15 a schematic perspective view of a manway of a scaffolding arrangement in accordance with at least some embodiments of the present invention is illustrated. The manway to the lower platforms 811 can be arranged by providing stairs outside the platforms or by a sheltered vertical ladder gangway 814. The gangway 814 may include an adjustable walkway 815 configured to be adapted to the mutual locations of the lower and upper working platforms. The ladder gangway 814 is designed to go through a working platform. The ladder gangway 814 provides multiple vertical fixing positions 816. The assembly is adjustable depending on the vertical distance between two decks.

Figure 16:
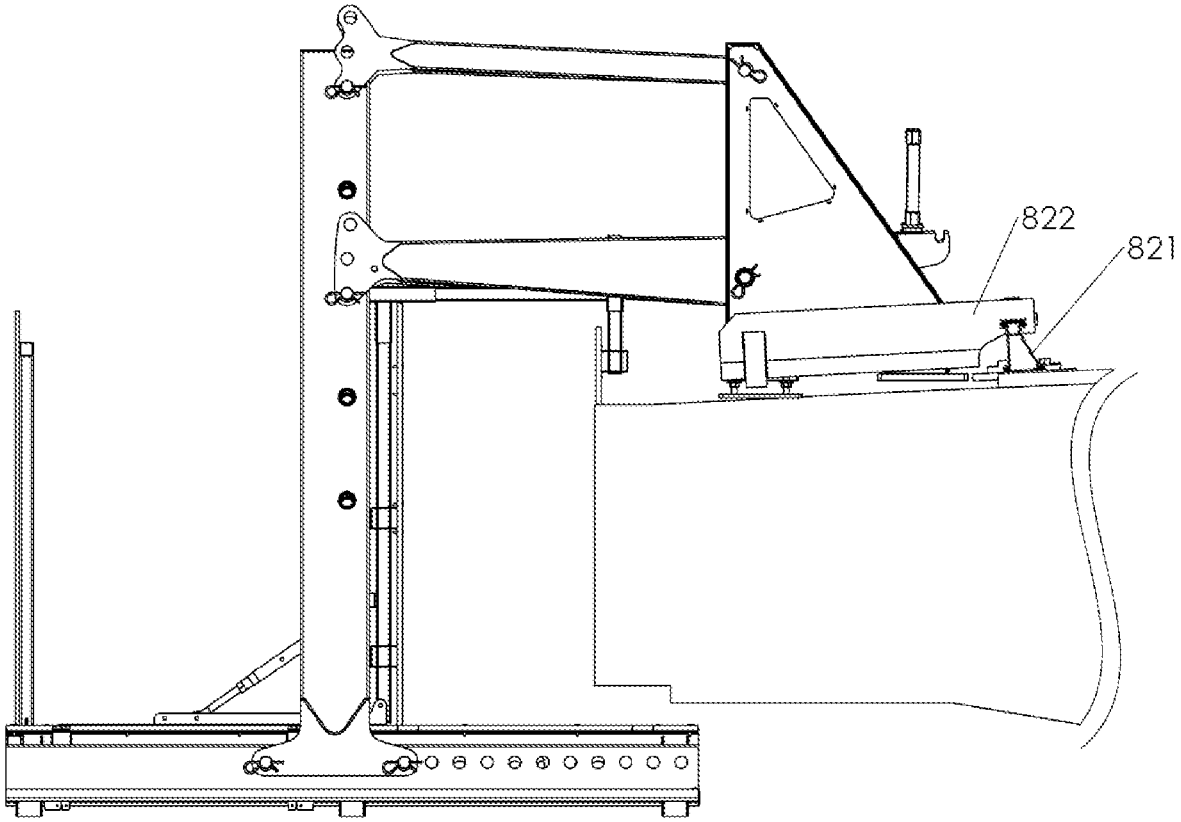
FIG. 16 illustrates a schematic side view of a rail of a scaffolding arrangement in accordance with at least some embodiments of the present invention.

In FIG. 16 a schematic side view of a rail of a scaffolding arrangement in accordance with at least some embodiments of the present invention is illustrated. In addition to fixing the hanger pedestals to the bridge with injection bolts, there can be a rail 821 arranged which is connected to the pedestals. The rail enables operation on bridges and decks, wherein the concrete spots are too damaged for safe injection of the bolts. The rail 821 comprises its own adjustable fixing adapters which can be injected into the bridge or deck with suitable spacing.

Another advantage of the rail 821 is the ability to transport systems of hangers and platforms along a bridge with suitable trolleys 822. By means of such an arrangement intermediate crane operations are not required.

If the rail 821 extends to a bridge wing wall or river bank, a system of scaffolds and platforms can be assembled and mounted even totally outside the bridge, thus causing no traffic limitation. The system or the systems can then towed or pushed forward along the bridge via the rail 821 according to certain phases of a project being finished in one mounting position at a time.

Figure 17:
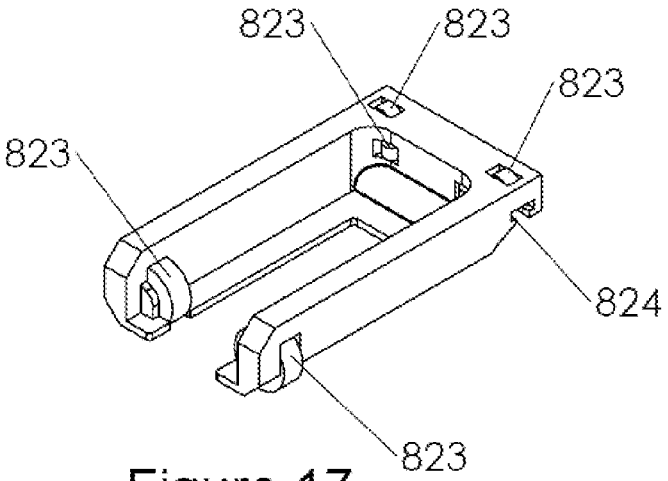
FIG. 17 illustrates a schematic perspective view of a trolley of a scaffolding arrangement in accordance with at least some embodiments of the present invention.

In FIG. 17 a schematic perspective view of a trolley of a scaffolding arrangement in accordance with at least some embodiments of the present invention is illustrated. The trolley comprises wheels 823 for transportation and locking jaws 824 for keeping the hangers stationary during operation. According to a certain embodiment, the wheels can be vertically adjusted and lifted off the rail when the jaws are tightened to lock the hangers in relation to the rail.

Figure 18:
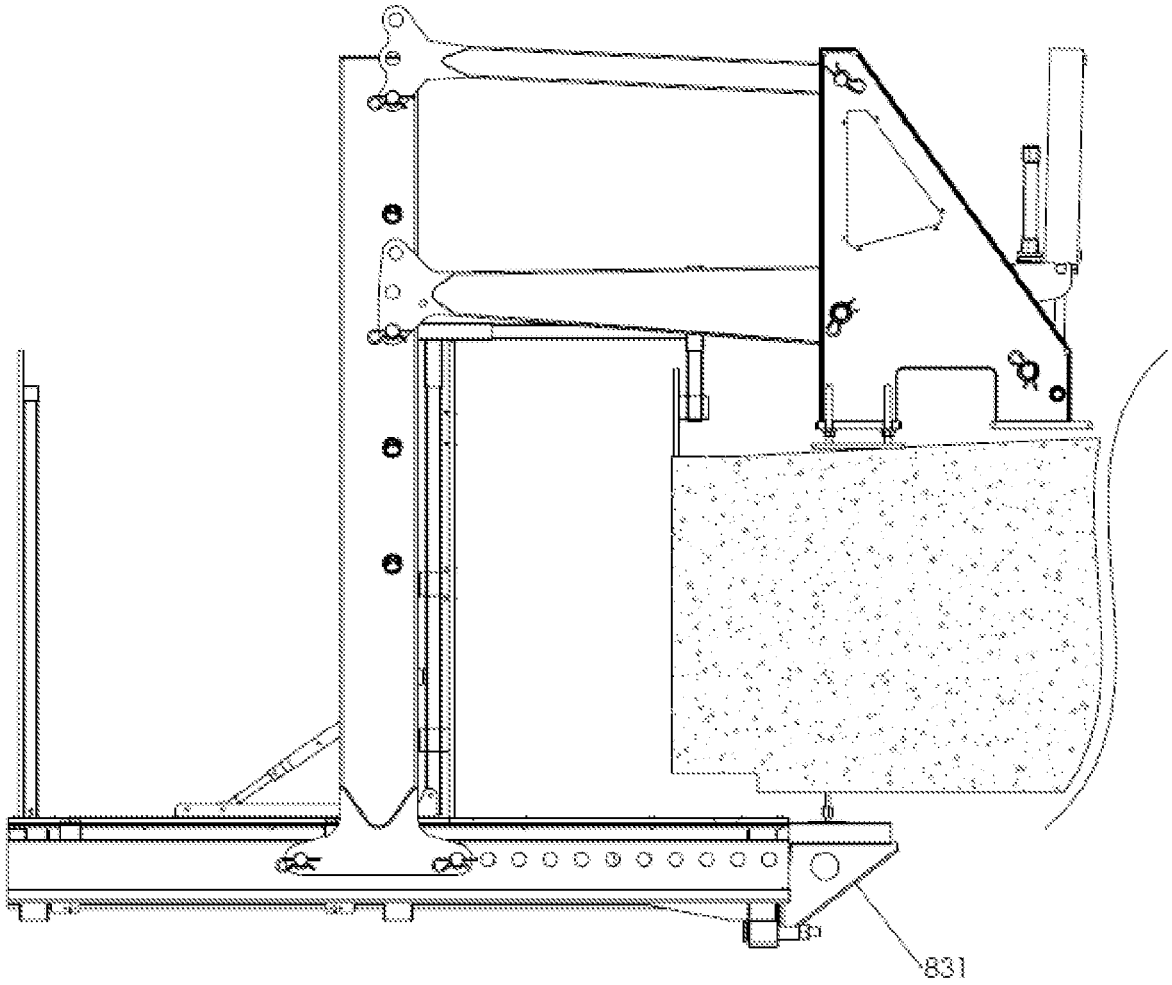
FIG. 18 illustrates a schematic side view of a working platform of a scaffolding arrangement in accordance with at least some embodiments of the present invention, wherein the working platform comprises a console.

In FIG. 18 a schematic side view of a working platform of a scaffolding arrangement in accordance with at least some embodiments of the present invention is illustrated, wherein the working platform comprises a console 831. The working platform can be equipped with consoles 831. The consoles 831 provide additional adjustable extensions for lashings.

Figure 19:
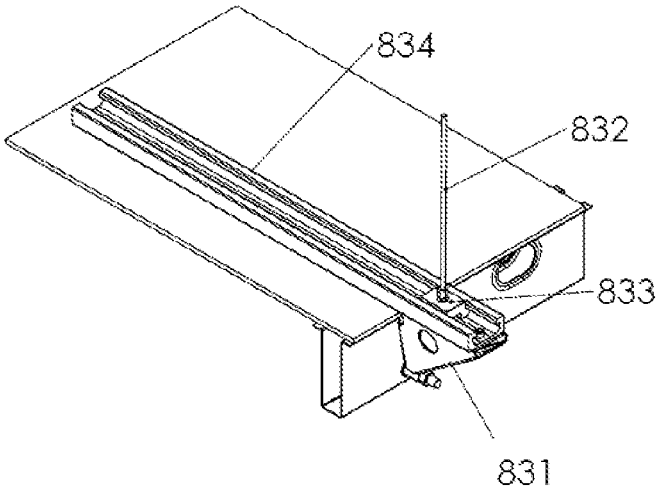
FIG. 19 illustrates a schematic perspective view of a working platform of a scaffolding arrangement in accordance with at least some embodiments of the present invention, wherein the working platform comprises a console.

In FIG. 19 a schematic perspective view of a working platform of a scaffolding arrangement in accordance with at least some embodiments of the present invention is illustrated, wherein the working platform comprises a console 831. A vertical lashing 832 can be connected to a bridge or deck structure. The lashing 832 is connected to a slider 833 at one end. The slider 833 is inserted into a hollow profile 834 which is attached to the platform. Such an arrangement enables placing the vertical lashing 832 outside of the working platform under solid concrete. The arrangement may be required in case that the edge beam concrete is in bad condition.

Figure 20:
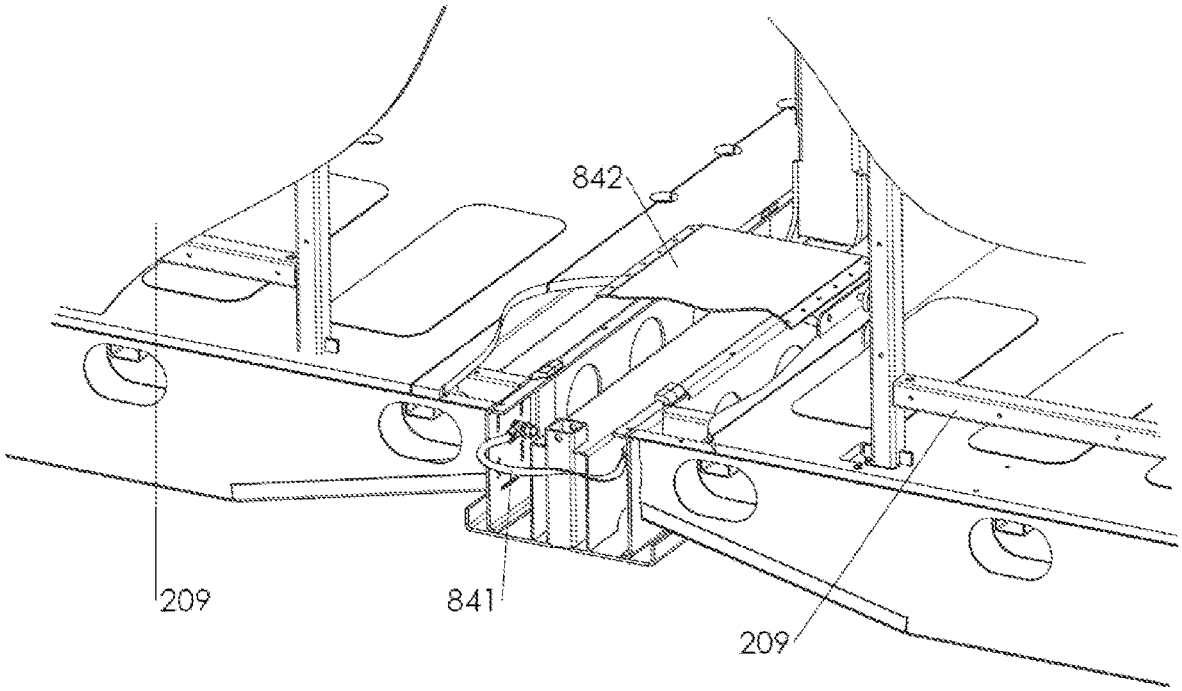
FIG. 20 illustrates a schematic perspective view of a working platform of a scaffolding arrangement in accordance with at least some embodiments of the present invention, wherein the working platform comprises grounding cables.

In FIG. 20 a schematic perspective view of a working platform of a scaffolding arrangement in accordance with at least some embodiments of the present invention is illustrated, wherein the working platform comprises grounding cables. When working close to high voltage wires the platforms can be grounded by short grounding cables 841 connecting adjacent platform ends. Typically, cables 841 are arranged at the end of each platform such that they can be mounted when the protective railings 209 are in place. This enables safe grounding work from the platforms without need for any personal lifting devices. The working platforms are further joined together by an intermediate plate 842. Thus, a flush working surface is created in the area between adjacent working platforms. The plate 842 has a pre-cut close tolerated slot for the vertical beam.

Figure 21:
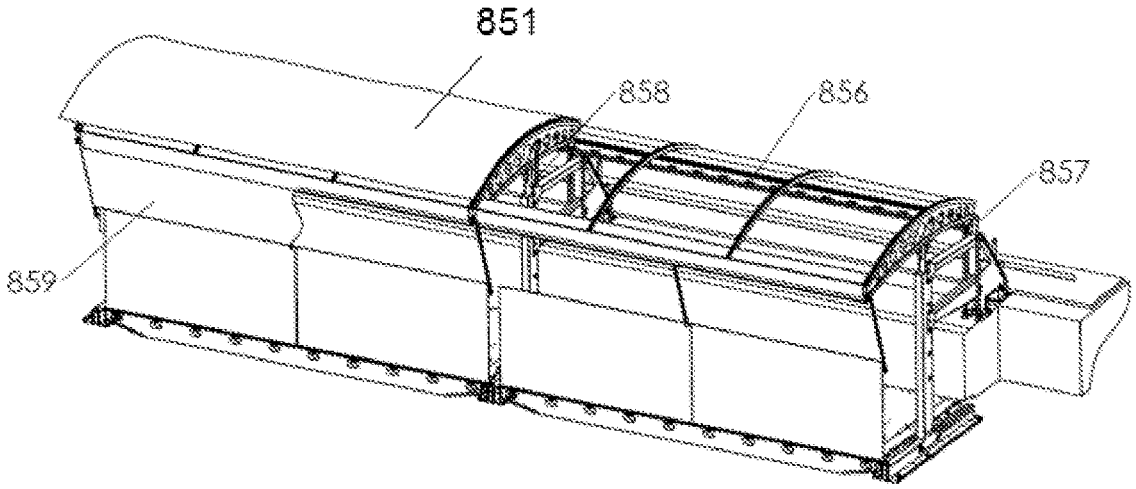
FIG. 21 illustrates a schematic perspective view of a scaffolding arrangement in accordance with at least some embodiments of the present invention, wherein the arrangement comprises a weather protection roof.

In FIG. 21 a schematic perspective view of a scaffolding arrangement in accordance with at least some embodiments of the present invention is illustrated, wherein the arrangement comprises a weather protection roof 851. The roof 851 enables working in heavy rain or snowing conditions. Weather protection frames can be supported by rods 857 and vertical beam tops with rods 858. The roof is preferably made from material which can be roled away, stacked or totally removed in case that wind speeds exceed over safety limits.

Additionally, the arrangement can be provided with protection plates, meshes, tarpaulins or other closing members 859 between the roof and the railings, thus forming a totally sheltered working environment. The lower deck platform railings can also be equipped with such vertical sheltering items in order to form a closed corridor.

Figure 22:
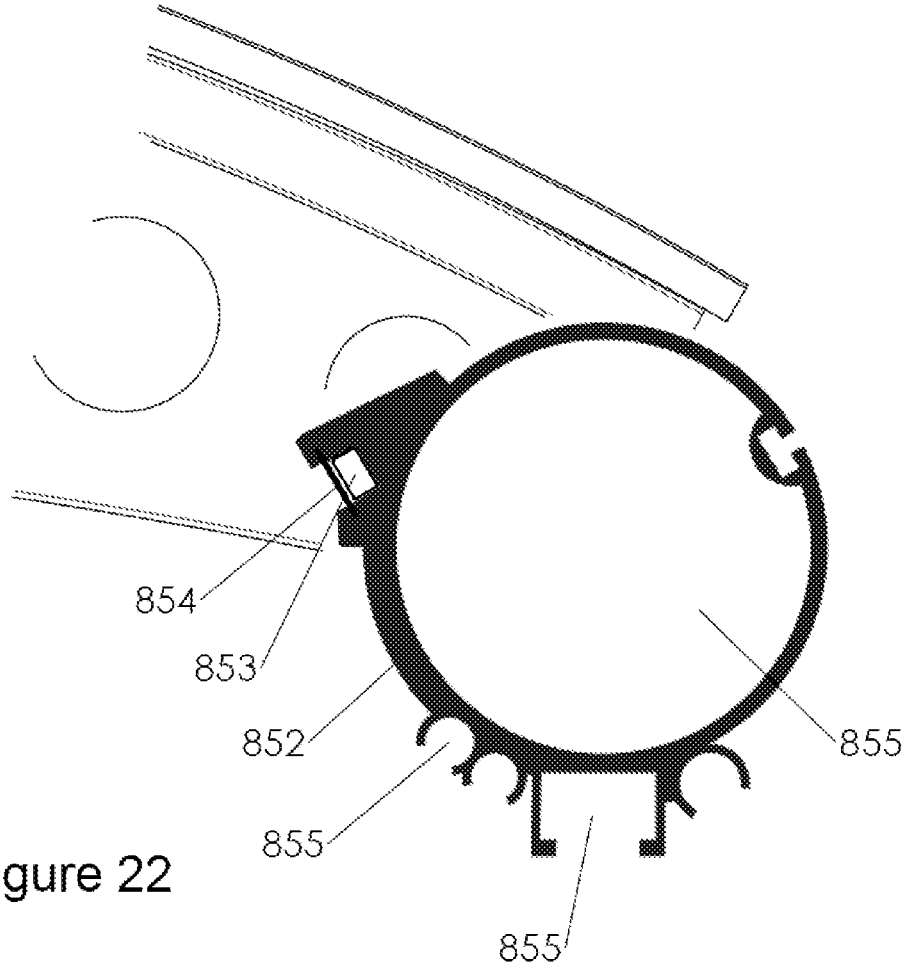
FIG. 22 illustrates a schematic view of a roof of a scaffolding arrangement in accordance with at least some embodiments of the present invention.

In FIG. 22 a schematic view of a roof of a scaffolding arrangement in accordance with at least some embodiments of the present invention is illustrated. The weather protection framework 852 can carry lights, preferably LEDs, with replaceable transparent protections 854 for the lights. Further, the weather protection framework can carry electric supplies 855, pressure air supplies 855, and heating air nozzles 856. Hot and cold water lines can also be included in the framework. Thus, the working area can be kept free of cables and other objects.

It is obvious that the various parts of the examples described above can be replaced with functional and structural equivalents within the scope defined by the Claims.

Current state of the art scaffolding uses components from which the system is put together. There are some computer program products made to help dimensioning and planning of the project. None of the existing systems form a complete process with lifetime tracking and maintenance history. Also no other related product uses foam molds which cutting data can be automatically written out from software for library based profiles.

According to certain embodiment, a hardware system with tested components and dedicated software is provided. A production process is formed enabling optimized assemblies with strict safety standards minimizing mistake risks, enabling automated document production and automated cutting programs for foam molds. The process also enables tracking of individual components with maintenance history.

The entire system and each of its components have a known performance in terms of maximum allowable loads, load combinations, life cycles and stability. The process software enables picking the best alternatives among system components to form an optimum combination for each project having different loads and different environmental requirements.

The end user does not need to make a complicated design and a strength analysis. The software has the components' and the combined systems' performance data incorporated. There is also a library of predefined edge beam profiles and edge beam structures. Some profiles can also be parametrized to enable automated production of foam mold CNC programs. The only requirement for end user is to choose system components and possibly additional supports (lashings) to keep calculated resulting loads in acceptable level. Software warns about unallowable dimensions and overloading and gives guidance for preferable actions. The preferred choosing process is iterative, giving end user also feeling of different alternatives effects. Also explicit straight solving of choices can be utilized in some cases. Some essential test requirements for bolt injection are also calculated and presented. The result from analysis process is an automatic analysis report for authorities and check list for end user.

Another advantage with the process is a definition and a list of required components (BOM, Bill of Materials) in each project. The user defines mold rotation preferences and gets corresponding BOM. The planning tool shows the configuration of the system(s) to be used at the specific site and position.

Further, the software gives guidance and makes schedule of deliveries and resource requirements based on previous experiences from similar type of projects. The end user can change given estimated resource requirements according to own preferences and experiences. With the BOM the schedule can be used for reserving components from component warehouse, preventing overbooking and enabling optimized deliveries. A booking document enables a renting service provider to make a quotation based on a component demand to optimize utilization.

Each system component has unique individual ID:s. Scheduling and BOM:s enable continuous tracking of component life cycle usage and optimized component maintenance with intermediate strength tests.

The foam molds can be pressed, burned, or recycled after use in the scaffolding arrangement.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to one embodiment or an embodiment means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment. Where reference is made to a numerical value using a term such as, for example, about or substantially, the exact numerical value is also disclosed.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In this description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The verbs "to comprise" and "to include" are used in this document as open limitations that neither exclude nor require the existence of also un-recited features. The features recited in depending claims are mutually freely combinable unless otherwise explicitly stated. Furthermore, it is to be understood that the use of "a" or "an", that is, a singular form, throughout this document does not exclude a plurality.

INDUSTRIAL APPLICABILITY

At least some embodiments of the present invention find industrial application in repair work on a bridge deck.

CITATION LIST

Patent Literature

WO 2008/132277 A1
WO 2012/062968 A1

The invention claimed is:

1. A scaffolding arrangement to be attached to a deck structure, comprising:

a set of arms including a carrier beam for carrying working levels and support structures needed in work;

an attachment frame for attaching the set of arms to an upper surface of the deck structure;

at least one platform for forming working levels;

a locking mechanism for locking the at least one platform, used for forming the working levels, to the carrier beam in a manner that the locking mechanism allows enough play so that the at least one platform can be tilted in relation to a longitudinal axis of the carrier beam; and at least one support shelf formed on the carrier beam for supporting the at least one platform, the at least one platform having end profiles with protruding lower edges, one of said protruding edges resting on the at least one support shelf, the at least one support shelf having turned edges for holding one of the protruding lower edges of the at least one platform, said at least one shelf dimensioned wide enough to allow tilting of the at least one platform, and forms a working level that follows a curvature of an edge of the deck structure, wherein the locking mechanism comprises a locking guide formed at the end profiles of the platform, a hole in the carrier beam, a locking hook, and a locking nail, wherein the locking hook is configured to slide into the locking guide and to pass through the hole, and further configured to slide sideways when the locking nail is pushed into the locking guide, the hole being dimensioned to allow the tilting of the at least one platform.

2. The scaffolding arrangement according to claim 1, wherein the arrangement includes at least two of said platforms, of which at least one has at least one edge that forms an angle with at least one adjoining edge.

3. The scaffolding arrangement according to claim 1, wherein the at least one platform is one of: rectangular, trapezoid and isosceles trapezoid.

4. The scaffolding arrangement according to claim 1, wherein the at least one platform comprises at least one keyhole profile.

5. The scaffolding arrangement according to claim 1, wherein the locking mechanism for locking the at least one platform allows enough play so that the platform can be tilted in relation to the longitudinal axis of the carrier beam for 1-5°.

6. The scaffolding arrangement according to claim 4, further comprising at least one bracket with locking elements for gripping the keyhole profile.

7. The scaffolding arrangement according to claim 6, wherein the bracket comprises at least one of the group consisting of:

elements for fine adjustment of the position of the bracket, a push beam, a leg profile, and a rigging screw, two openings in the leg profile, and two openings in the leg profile wherein grooves are arranged at two sides of each opening and the grooves optionally have a different phase on opposite sides of the respective opening.

8. The scaffolding arrangement according to claim 6, wherein the locking mechanism comprises a tooth key.

9. The scaffolding arrangement according to claim 6, the at least one bracket (205, 708) comprises a push beam (724), a leg profile (710) and a rigging screw (711), whereby the push beam is configured to rotate about an axis of rotation relative to the leg profile.

10. The scaffolding arrangement according to claim 9, wherein at least a portion of the push beam can be arranged within the leg profile.

11. The scaffolding arrangement according to claim 1, wherein the arrangement further comprises at least one of the group consisting of:

a mold made of foam, a lower platform, adjustable support legs, a gangway comprising an adjustable walkway and optionally including a plurality of fixing positions, a rail, a trolley optionally including wheels which can be adjusted in vertical direction, a console including a lashing, wherein a position of the lashing is optionally adjustable in relation to the platform, and a roof including at least one of a light, an electric supply, a pressure supply, and a heating air supply.

12. The scaffolding arrangement according to claim 1, wherein the locking mechanism for locking the at least one platform allows enough play so that the platform can be tilted in relation to the longitudinal axis of the carrier beam for 1-3°.

* * * * *